US009215894B2

(12) United States Patent
Kizer et al.

(10) Patent No.: US 9,215,894 B2
(45) Date of Patent: Dec. 22, 2015

(54) APPARATUSES, SYSTEMS, AND ASSOCIATED METHODS FOR FORMING ORGANIC POROUS MASSES FOR FLAVORED SMOKE FILTERS

(71) Applicant: Celanese Acetate LLC, Irving, TX (US)

(72) Inventors: Lawton E. Kizer, Blacksburg, VA (US); Raymond M. Robertson, Blacksburg, VA (US); Zeming Gou, Pearisburg, VA (US); Yi (Julie) Li, Blacksburg, VA (US)

(73) Assignee: Celanese Acetate LLC, Irving, TX (US)

( * ) Notice: Subject to any disclaimer, the term of this patent is extended or adjusted under 35 U.S.C. 154(b) by 0 days.

(21) Appl. No.: 14/203,613

(22) Filed: Mar. 11, 2014

(65) Prior Publication Data

US 2014/0261475 A1 Sep. 18, 2014

Related U.S. Application Data

(60) Provisional application No. 61/781,085, filed on Mar. 14, 2013.

(51) Int. Cl.
*A24D 3/02* (2006.01)

(52) U.S. Cl.
CPC ..... *A24D 3/0225* (2013.01)

(58) Field of Classification Search
USPC ..... 131/274–276, 331, 332, 341, 342; 493/39, 42, 43, 36; 264/122, 123, 125, 264/126
See application file for complete search history.

(56) References Cited

U.S. PATENT DOCUMENTS

| | | | | |
|---|---|---|---|---|
| 7,503,960 | B2 | 3/2009 | Plunkett et al. | |
| 7,740,423 | B2 * | 6/2010 | Newbolt et al. | 406/14 |
| 2008/0090081 | A1 | 4/2008 | Matsumoto et al. | |
| 2011/0100384 | A1 | 5/2011 | Newbery et al. | |
| 2013/0032158 | A1 * | 2/2013 | Garrett et al. | 131/280 |

FOREIGN PATENT DOCUMENTS

| | | | |
|---|---|---|---|
| KR | 100785345 | B1 | 12/2007 |
| WO | 2012047346 | A1 | 4/2012 |
| WO | 2012047347 | A1 | 4/2012 |
| WO | 2012047348 | A1 | 4/2012 |
| WO | 2012047349 | A1 | 4/2012 |
| WO | 2012051548 | A2 | 4/2012 |
| WO | 2014150313 | A1 | 9/2014 |

OTHER PUBLICATIONS

International Search Report and Written Opinion for PCT/US2014/022923 dated Jun. 3, 2014.

* cited by examiner

*Primary Examiner* — Dennis Cordray
(74) *Attorney, Agent, or Firm* — McDermott Will & Emery LLP; Kurt Jones

(57) ABSTRACT

Organic porous masses may be used in flavored smoke filters. Production of organic porous masses may involve introducing a matrix material into a mold cavity, the matrix material comprising a plurality of binder particles, a plurality of organic particles, and a microwave enhancement additive; heating at least a portion of the matrix material so as to bind the matrix material at a plurality of contact points, thereby forming an organic porous mass length, wherein heating involves irradiating with microwave radiation the at least a portion of the matrix material; and cutting the organic porous mass length radially thereby yielding an organic porous mass.

14 Claims, 16 Drawing Sheets

APPARATUSES, SYSTEMS, AND ASSOCIATED METHODS FOR FORMING ORGANIC POROUS MASSES FOR FLAVORED SMOKE FILTERS

BACKGROUND

The present invention relates to apparatuses, systems, and associated methods for high-throughput manufacturing organic porous masses that may be used in flavored smoke filters.

Flavored smoking devices (e.g., cigarettes) make up a large market segment, especially in Eastern Asia, Indonesia, and India. Conventionally, flavored smoking devices are made by spraying a flavorant (typically an essential oil) in an alcohol solution onto the tobacco or filters used to make up the smoking devices. When such tobacco is smoked, the flavorant volatilizes and enters the smoke stream imparting flavor to the smoker. However, much of the taste effect of the flavorant is lost in the sidestream smoke of the smoking devices as the tobacco burns with only a small percentage reaching the smoker through the filter. As a result, excessive amounts of flavorant are generally applied to the tobacco in order to achieve a satisfactory taste effect.

Furthermore, a significant amount of the flavorant is lost to the atmosphere during the spraying application, which is the primary way of applying it to the tobacco. Another related disadvantage is that during storage and distribution of the smoking devices, a large percentage of the volatile flavorant is lost from the tobacco through the package, thereby limiting the effective shelf life of the product.

In alternate methods to impart flavor to cigarettes, various carbon or silica gel materials have been impregnated with flavorant, and the impregnated material is then used as the filter element in a cigarette. While these techniques provide some advantages over use of flavorant in tobacco, they still leave much to be desired, particularly insofar as delivery of the flavoring agent during smoking of the cigarette, and minimal use of flavoring agent in order to obtain a satisfactory taste in the final cigarette product. Further, the use of particulate additives (e.g., carbon and silica) can cause the draw resistance (measured as encapsulated pressure drop, "EPD") of the filter to change, which may turn off consumers.

Therefore, despite continued research, there remains an interest in developing improved and more effective mechanisms for adding flavorant to smoking devices that minimally affect draw characteristics of the smoking device.

BRIEF DESCRIPTION OF THE DRAWINGS

The following figures are included to illustrate certain aspects of the present invention, and should not be viewed as exclusive embodiments. The subject matter disclosed is capable of considerable modification, alteration, and equivalents in form and function, as will occur to those skilled in the art and having the benefit of this disclosure.

DETAILED DESCRIPTION

Figure 1B:
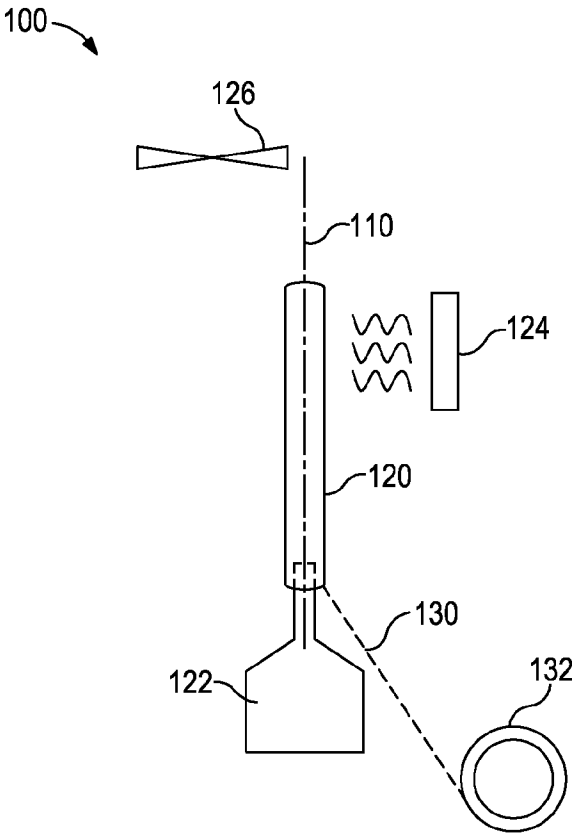
FIGS. 1A-B illustrate nonlimiting examples of systems for forming organic porous masses according to the present invention (not necessarily to scale).

The present invention relates to apparatuses, systems, and associated methods for manufacturing organic porous masses that may be used in flavored smoke filters, including high-throughput methods and associated apparatuses and systems.

The organic porous masses described herein utilize organic particles rather than essential oils to introduce flavor into the smoke stream. As used herein, the term "organic particles" refers to natural compositions that are capable of imparting a flavor (e.g., by releasing essential oils) when heated or as another fluid is drawn through the filter. The use of organic particles allows for the flavorant to be in a natural state which prolongs product shelf life and mitigates flavorant deterioration (e.g., by oxidation). Further, traditional filters (e.g., cellulose acetate tow filters) that include flavorants sprayed thereon, typically lose a significant amount of flavor through the end of the cigarette. The organic porous masses described herein may advantageously be utilized in an internal segment of a segmented filter (i.e., having at least one filter segment on either side), which may provide for additional flavor retention and shelf-life.

Organic porous masses may be incorporated as segments or sections in a smoking device filter. In some embodiments, the increased temperature of the smoke stream may enhance the release of flavorant from the organic particles.

Further, the encapsulated pressure drop, a measure of draw resistance, can be tailored for the organic porous masses. For example, the length of the organic porous masses can be changed, which can change the flavorant dosage to the smoker. This tailorability may also allow for the production of filters with essentially the same EPD as filters without the organic porous masses, which then may allow for easier market acceptance of the new flavorant mechanism.

The term "organic porous mass" as used herein refers to a mass comprising a plurality of binder particles and a plurality of organic particles mechanically bound at a plurality of contact points. Said contact points may be organic particle-binder contact points, binder-binder contact points, and/or organic particle-organic particle contact points. As used herein, the terms "mechanical bond," "mechanically bonded," "physical bond," and the like refer to a physical connection that holds two particles together. Mechanical bonds may be rigid or flexible depending on the bonding material. Mechanical bonding may or may not involve chemical bonding. Generally, the mechanical bonding does not involve an adhesive, though, in some embodiments, an adhesive may be used after mechanical bonding to adhere other additives to portions of the organic porous mass.

As used herein, the terms "particle" and "particulate" may be used interchangeably and include all known shapes of materials, including spherical and/or ovular, substantially spherical and/or ovular, discus and/or platelet, flake, ligamental, acicular, fibrous, polygonal (such as cubic), randomly shaped (such as the shape of crushed rocks), faceted (such as the shape of crystals), or any hybrid thereof.

Organic porous masses may be produced through a variety of methods. For example, some embodiments may involve forming the matrix material (e.g., the organic particles and binder particles) into a desired shape (e.g., with a mold), heating the matrix material to mechanically bond the matrix material together, and finishing the organic porous masses (e.g., cutting the organic porous masses to a desired length). Of the various processes/steps involved in the production of porous masses, forming the matrix material into a desired shape while maintaining a homogenous dispersion and heating may be two of the steps that limit high-throughput manufacturing. Accordingly, methods that employ pneumatic dense phase feed may be involved in preferred methods for high-throughput manufacturing of organic porous masses described herein (e.g., about 300 m/min to about 800 m/min).

The organic particles described herein may be capable of converting microwaves into heat that provides for rapid sintering of the organic porous masses described herein, which may allow for high-throughput manufacturing of organic porous masses. However, significant heating of organic particles may deteriorate the flavor (e.g., by oxidizing or burning the organic particles). To mitigate such effects, some embodiments may utilize microwave enhancement additives. Further, the production method may be designed to maximize the function of the microwave enhancement additive and minimize the microwave interaction with the organic particles. For example, some microwave enhancement additives may interact with different frequencies of microwaves to different degrees. As such, microwave enhancement additives may be chosen to have a corresponding optimal microwave frequency that interacts with the organic particles to a lesser degree.

Additionally, the use of organic particulates over other flavorant liquids may be that the organic particulates are capable of flowing with the binder particles for a substantially homogenous blend and consequently a more homogeneous organic porous mass. Whereas the use of a liquid flavorant would most likely cause clumping of the binder particles and defects in the organic porous masses produced therefrom.

It should be noted that when "about" is provided herein in reference to a number in a numerical list, the term "about" modifies each number of the numerical list. It should be noted that in some numerical listings of ranges, some lower limits listed may be greater than some upper limits listed. One skilled in the art will recognize that the selected subset will require the selection of an upper limit in excess of the selected lower limit.

I. Methods and Apparatuses for Forming Organic Porous Masses

The process of forming organic porous masses may include continuous processing methods, batch processing methods, or hybrid continuous-batch processing methods. As used herein, "continuous processing" refers to manufacturing or producing materials without interruption. Material flow may be continuous, indexed, or combinations of both. As used herein, "batch processing" refers to manufacturing or producing materials as a single component or group of components at individual stations before the single component or group proceeds to the next station. As used herein, "continuous-batch processing" refers to a hybrid of the two where some processes, or series of processes, occur continuously and others occur by batch.

Generally organic porous masses may be formed from matrix materials. As used herein, the term "matrix material" refers to the precursors, e.g., binder particles and organic particles, used to form organic porous masses. In some embodiments, the matrix material may comprise, consist of, or consist essentially of binder particles and organic particles. In some embodiments, the matrix material may comprise binder particles, organic particles, and additives. Nonlimiting examples of suitable binder particles, organic particles, and additives are provided in this disclosure.

As described above, the encapsulated pressure drop ("EPD"), a measure of the draw characteristics of a filter, may depend on, inter alia, the size and shape of the binder particles, the size and shape of the organic particles, the concentration of each of the binder particles inorganic particles, and the size, shape, and concentration of any additives. As such, the manufacturing methods described herein may, in some embodiments, involve sizing the matrix material, or components thereof. For example, sizing may involve filtering or sieving the matrix material, or components thereof, e.g., with standard mesh procedures.

The use of organic particles described herein, in some instances, pose unique manufacturing challenges. For example, organic particles for use in organic porous masses may be produced by grinding natural compositions. It should be noted that unless otherwise specified, the term "grinding" encompasses similar processes like cutting, chopping, crushing, milling, pulverizing, and the like, including cryogenic versions of the foregoing.

In some instances, the grinding (or the like) of natural materials releases moisture and essential oils that can cause the organic particles to aggregate, which changes the corresponding organic particle size and may ultimately affect the characteristics of the organic porous masses produced therefrom. Further, when producing organic porous masses with such aggregates, it has been observed that some of the organic porous masses have wrinkled wrappers, voids, and dents.

To mitigate organic particle aggregation, some embodiments may involve drying the organic particles. In some instances, drying may involve heating the organic particles at a reduced air pressure (i.e., a pressure less than atmospheric pressure). For example, a vacuum oven at about 20° C. to about 80° C. (including subsets thereof, e.g., about 40° C. to about 60° C.) may be utilized for minutes to hours depending on, inter alia, the amount of organic particles, the relative surface area, and the air pressure during heating. It should be noted that the drying temperature may be outside the preferred range described and is within the scope of the present invention.

In some instances, drying the organic particles may occur before, after, and/or during sizing the organic particles. In some instances, sizing may be eliminated where the grinding process (or the like) provides a desired organic particle size and drying minimizes aggregation.

Forming organic porous masses may generally include forming a matrix material into a shape (e.g., suitable for incorporating into as smoking device filter, a water filter, an air filter, or the like) and mechanically bonding (e.g., by sintering) at least a portion of the matrix material at a plurality of contact points (e.g., a plurality of sintered contact points).

Forming a matrix material into a shape may involve a mold cavity. In some embodiments, a mold cavity may be a single piece or a collection of single pieces, either with or without end caps, plates, or plugs. In some embodiments, a mold cavity may be multiple mold cavity parts that when assembled form a mold cavity. In some embodiments, mold cavity parts may be brought together with the assistance of conveyors, belts, and the like. In some embodiments, a mold cavity or parts thereof may be stationary along the material path and configured to allow for conveyors, belts, and the like to pass therethrough, where the mold cavity may expand and contract radially to provide a desired level of compression to the matrix material.

A mold cavity may have any cross-sectional shape including, but not limited to, circular, substantially circular, ovular, substantially ovular, polygonal (like triangular, square, rectangular, pentagonal, star, and so on), polygonal with rounded edges (including flower-like), donut, and the like, or any hybrid thereof. In some embodiments, organic porous masses may have a cross-sectional shape comprising holes or channels, which may be achieved by the use of one or more dies, by machining, by an appropriately shaped mold cavity, or any other suitable method (e.g., degradation of a degradable material). In some embodiments, the organic porous mass may have a specific shape for a cigarette holder or pipe that is adapted to fit within the cigarette holder or pipe to allow for smoke passage through the filter to the consumer. When discussing the shape of an organic porous mass herein, with respect to a traditional smoking device filter, the shape may be referred to in terms of diameter or circumference (wherein the circumference is the perimeter of a circle) of the cross-section of the cylinder. But in embodiments where an organic porous mass of the present invention is in a shape other than a true cylinder, it should be understood that the term "circumference" is used to mean the perimeter of any shaped cross-section, including a circular cross-section.

Generally, mold cavities may have a longitudinal direction and a radial direction perpendicular to the longitudinal direction, e.g., a substantially cylindrical shape. One skilled in the art should understand how to translate the embodiments presented herein to mold cavities without defined longitudinal and radial direction, e.g., spheres and cubes, where applicable. In some embodiments, a mold cavity may have a cross-sectional shape that changes along the longitudinal direction, e.g., a conical shape, a shape that transitions from square to circular, or a spiral. In some embodiments with a sheet-shaped mold cavity (e.g., formed by an opening between two plates), the longitudinal direction would be the machine direction or flow of matrix material direction. In some embodiments, a mold cavity may be paper rolled or shaped into a desired cross-sectional shape, e.g., a cylinder. In some embodiments, a mold cavity may be a cylinder of paper glued at the longitudinal seam.

In some embodiments, mold cavities may have a longitudinal axis having an opening as a first end and a second end along said longitudinal axis. In some embodiments, matrix material may pass along the longitudinal axis of a mold cavity during processing. By way of nonlimiting example, FIG. 1 shows mold cavity 120 with a longitudinal axis along material path 110.

In some embodiments, mold cavities may have a longitudinal axis having a first end and a second end along said longitudinal axis wherein at least one end is closed. In some embodiments, said closed end may be capable of opening.

In some embodiments, individual mold cavities may be filled with a matrix material prior to mechanical bonding (e.g., sintering or forming sintered contact points). In some embodiments, a single mold cavity may be used to continuously produce organic porous masses by continuously passing matrix material therethrough before and/or during mechanical bonding. In some embodiments, a single mold cavity may be used to produce an individual organic porous mass. In some embodiments, said single mold cavity may be reused and/or continuously reused to produce a plurality of individual organic porous masses.

In some embodiments, mold cavities may be at least partially lined with wrappers and/or coated with release agents. In some embodiments, wrappers may be individual wrappers, e.g., pieces of paper. In some embodiments, wrappers may be spoolable-length wrappers, e.g., a 50 ft roll of paper.

In some embodiments, mold cavities may be lined with more than one wrapper. In some embodiments, forming organic porous masses may include lining a mold cavity(s) with a wrapper(s). In some embodiments, forming organic porous masses may include wrapping the matrix material with wrappers so that the wrapper effectively forms the mold cavity. In such embodiments, the wrapper may be performed as a mold cavity, formed as a mold cavity in the presence of the matrix material, or wrapped around matrix material that is in a preformed shape (e.g., with the aid of a tackifier). In some embodiments, wrappers may be continuously fed through a mold cavity. Wrappers may be capable of holding the organic porous mass in a shape, capable of releasing the organic porous masses from the mold cavities, capable of assisting in passing matrix material through the mold cavity, capable of protecting the organic porous mass during handling or shipment, and any combination thereof.

Suitable wrappers may include, but not be limited to, papers (e.g., wood-based papers, papers containing flax, flax papers, papers produced from other natural or synthetic fibers, functionalized papers, special marking papers, colorized papers), plastics (e.g., fluorinated polymers like polytetrafluoroethylene, silicone), films, coated papers, coated plastics, coated films, and the like, and any combination thereof. In some embodiments, wrappers may be papers suitable for use in smoking device filters.

In some embodiments, a wrapper may be adhered (e.g., glued) to itself to assist in maintaining a desired shape, e.g., in a substantially cylindrical configuration. In some embodiments, mechanical bonding of the matrix material may also mechanically bind (or sinter) the matrix material to the wrapper which may alleviate the need for adhering the wrapper to itself.

Suitable release agents may be chemical release agents or physical release agents. Nonlimiting examples of chemical release agents may include oils, oil-based solutions and/or suspensions, soapy solutions and/or suspensions, coatings bonded to the mold surface, and the like, and any combination thereof. Nonlimiting examples of physical release agents may include papers, plastics, and any combination thereof. Physical release agents, which may be referred to as release wrappers, may be implemented similar to wrappers as described herein.

Once formed into a desired cross-sectional shape with the mold cavity, the matrix material may be mechanically bound at a plurality of contact points. Mechanical bonding may occur during and/or after the matrix material is in the mold cavity. Mechanical bonding may be achieved with heat and/or pressure and without adhesive (e.g., forming a sintered contact points). In some instances, an adhesive may optionally be included.

Heat may be radiant heat, conductive heat, convective heat, and any combination thereof. Heating may involve thermal sources including, but not limited to, heated fluids internal to the mold cavity, heated fluids external to the mold cavity, steam, heated inert gases, secondary radiation from a component of the organic porous mass (e.g., nanoparticles, organic particles, and the like), ovens, furnaces, flames, conductive or thermoelectric materials, ultrasonics, and the like, and any combination thereof. By way of nonlimiting example, heating may involve a convection oven or heating block. Another nonlimiting example may involve heating with microwave energy (single-mode or multi-mode applicator). In another nonlimiting example, heating may involve passing heated air, nitrogen, or other gas through the matrix material while in the mold cavity. In some embodiments, heated inert gases may be used to mitigate any unwanted oxidation of organic particles and/or additives. Another nonlimiting example may involve mold cavities made of thermoelectric materials so that the mold cavity heats. In some embodiments, heating may involve a combination of the foregoing, e.g., passing heated gas through the matrix material while passing the matrix material through a microwave oven.

In some embodiments, organic particles may be in a green form (e.g., not roasted). In some embodiments, heating matrix material comprising green organic particles may advantageously roast the green organic particles, thereby changing the flavor profile of the organic particles. Examples of such particles may include, but are not limited to, coffee, hops, sugar, and the like.

In some instances, the matrix material may further comprise a microwave enhancement additive that absorb microwaves more efficiently than the organic particles described herein. As such, microwave enhancement additives may allow for the production of organic porous masses, including via high-throughput methods, with reduced time at elevated temperatures, which may, in turn, mitigate flavor deterioration. Suitable microwave enhancement additives may include, but not be limited to, microwave responsive polymers, carbon particles (e.g., carbon black), fullerenes, carbon nanotubes, metal nanoparticles, water, and the like, and any combination thereof. In some embodiments, the microwave enhancement additive may preferably not (or not substantially) adsorb flavorant, as such adsorption may diminish the flavor delivered to a smoker.

In some embodiments, microwave enhancement additives may be included in organic porous masses in an amount ranging from a lower limit of about 1%, 2%, or 3% to an upper limit of about 10%, 8%, or 5%, and wherein the amount may range from any lower limit to any upper limit and encompasses any subset therebetween. While amounts of microwave enhancement additives may be outside this range and within the scope of the present invention, the amount of microwave enhancement additives may preferably be lower so as to occupy more volume than needed and allow for a higher amount of organic particles.

In some instances, heat may be applied in an oxygen-lean atmosphere, which may mitigate oxidation of the organic particles and allow the organic particles to maintain a desirable level of flavorant with minimal undesirable byproducts. Examples of oxygen-lean atmospheres may include, but are not limited to, argon, nitrogen, carbon dioxide, reduced air pressures (e.g., pulling a partial vacuum on the mold cavity), and the like, and any combination thereof (e.g., purging with argon then pulling a partial vacuum). In some embodiments, heat may be applied at a reduced air pressure range from a lower limit of about 14 inHg, 15 inHg, or 20 inHg to an upper limit of about 30 inHg, 25 inHg, or 20 inHg, and wherein the reduced air pressure may range from any lower limit to any upper limit and encompasses any subset therebetween.

In some instances, heat may be applied at an elevated air pressure (i.e., an air pressure greater than atmospheric pressure) (optionally in an appropriate oxygen-lean atmosphere), which may advantageously mitigate volatilization of essential oils from the organic particles. In some embodiments, heat may be applied at an elevated air pressure range from atmospheric pressure to about 2 atm, including any subset therebetween. One skilled in the art should understand that air pressures may be used outside these ranges within the spirit of this disclosure and additional safety considerations may need to be taken into consideration.

In some instances, flavor preservation may be maximized by a combination of at least two of preheating, heating via microwave with a matrix material comprising a microwave enhancement additive, heating in an oxygen-lean atmosphere, heating at an elevated air pressure, and the like.

Secondary radiation from a component of the organic porous mass (e.g., nanoparticles, organic particles, and the like) may, in some embodiments, be achieved by irradiating the component with electromagnetic radiation, e.g., gamma-rays, x-rays, UV light, visible light, IR light, microwaves, radio waves, and/or long radio waves. By way of nonlimiting example, the matrix material may comprise carbon nanotubes that when irradiated with radio frequency waves emit heat. In another nonlimiting example, the matrix material may comprise organic particles like carbon particles that are capable of converting microwave irradiation into heat that mechanically bonds or assists in mechanically bonding the binder particles together. In some embodiments, the electromagnetic radiation may be tuned by the frequency and power level so as to appropriately interact with the component of choice. For example, activated carbon may be used in conjunction with microwaves at a frequency ranging from about 900 MHz to about 2500 MHz with a fixed or adjustable power setting that is selected to match a target rate of heating.

One skilled in the art, with the benefit of this disclosure, should understand that different wavelengths of electromagnetic radiation penetrate materials to different depths. Therefore, when employing primary or secondary radiation methods one should consider the mold cavity material, configuration and composition, the matrix material composition, the component that converts the electromagnetic radiation to heat, the wavelength of electromagnetic radiation, the intensity of the electromagnetic radiation, the irradiation methods, and the desired amount of secondary radiation, e.g., heat.

The residence time for heating (including by any method described herein, e.g., convection oven or exposure to electromagnetic radiation) and/or applying pressure that causes the mechanical bonding (e.g., forming sintered contact points) to occur may be for a length of time ranging from a lower limit of about a hundredth of a second, a tenth of a second, 1 second, 5 seconds, 30 seconds, or 1 minute to an upper limit of about 30 minutes, 15 minutes, 5 minutes, 1 minute, or 1 second, and wherein the residence time may range from any lower limit to any upper limit and encompasses any subset therebetween. It should be noted that for continuous processes that utilize faster heating methods, e.g., exposure to electromagnetic radiation like microwaves, short residence times may be preferred, e.g., about 10 seconds or less, or more preferably about 1 second or less. Further, processing methods that utilize processes like convection heating may provide for longer residence times on the timescale of minutes, which may include residence times of greater than 30 minutes. One of ordinary skill in the art should understand that longer times can be applicable, e.g., seconds to minutes to hours or longer provided that an appropriate temperature and heating profile may be selected for a given matrix material. It should be noted that preheating or pretreating methods and/or steps that are not to a sufficient temperature and/or pressure to allow for mechanical bonding are not considered part of the residence time, as used herein.

In some embodiments, heating to facilitate mechanical bonding may be to a softening temperature of a component of the matrix material. As used herein, the term "softening temperature" refers to the temperature above which a material becomes pliable, which is typically below the melting point of the material.

In some embodiments, mechanical bonding may be achieved at temperatures ranging from a lower limit of about 90° C., 100° C., 110° C., 120° C., 130° C., or 140° C. or an upper limit of about 300° C., 275° C., 250° C., 225° C., 200° C., 175° C., or 150° C., and wherein the temperature may range from any lower limit to any upper limit and encompass any subset therebetween. In some embodiments, the heating may be accomplished by subjecting material to a single temperature. In another embodiment the temperature profile may vary with time. By way of nonlimiting example, a convection oven may be used. In some embodiments, heating may be localized within the matrix material. By way of nonlimiting example, secondary radiation from nanoparticles may heat only the matrix material proximal to the nanoparticle.

In some embodiments, matrix materials may be preheated before entering mold cavities. In some embodiments, matrix material may be preheated to a temperature below the softening temperature of a component of the matrix material. In some embodiments, matrix material may be preheated to a temperature about 10%, about 5%, or about 1% below the softening temperature of a component of the matrix material. In some embodiments, matrix material may be preheated to a temperature about 10° C., about 5° C., or about 1° C. below the softening temperature of a component of the matrix material. Preheating may involve heat sources including, but not limited to, those listed as heat sources above for achieving mechanical bonding.

In some embodiments, bonding the matrix material may yield organic porous mass or organic porous mass lengths. As used herein, the term "organic porous mass length" refers to a continuous organic porous mass (i.e., an organic porous mass that is not never-ending, but rather long compared to organic porous masses, which may be produced continuously). By way of nonlimiting example, organic porous mass lengths may be produced by continuously passing matrix material through a heated mold cavity. In some embodiments, the binder particles may retain their original physical shape (or substantially retained their original shape, e.g., no more than 10% variation (e.g., shrinkage) in shape from original) during the mechanical bonding process, i.e., the binder particles may be substantially the same shape in the matrix material and in the organic porous mass (or lengths). For simplicity and readability, unless otherwise specified, the term "organic porous mass" encompasses organic porous mass sections, organic porous masses, and organic porous mass lengths (wrapped or otherwise).

In some embodiments, organic porous mass lengths may be cut to yield organic porous masses. Cutting may be achieved with a cutter. Suitable cutters may include, but not be limited to, blades, hot blades, carbide blades, stellite blades, ceramic blades, hardened steel blades, diamond blades, smooth blades, serrated blades, lasers, pressurized fluids, liquid lances, gas lances, guillotines, and the like, and any combination thereof. In some embodiments with high-speed processing, cutting blades or similar devices may be positioned at an angle to match the speed of processing so as to yield organic porous masses with ends perpendicular to the longitudinal axis. In some embodiments, the cutter may change position relative to the organic porous mass lengths along the longitudinal axis of the organic porous mass lengths.

In some embodiments, organic porous masses and/or organic porous mass lengths may be extruded. In some embodiments, extrusion may involve a die. In some embodiments, a die may have multiple holes being capable of extruding organic porous masses and/or organic porous mass lengths.

Some embodiments may involve cutting organic porous masses and/or organic porous mass lengths radially to yield organic porous mass sections. Cutting may be achieved by any known method with any known apparatus including, but not limited to, those described above in relation to cutting organic porous mass lengths into organic porous masses.

The length of an organic porous mass, or sections thereof, may range from a lower limit of about 2 mm, 3 mm, 5 mm, 10 mm, 15 mm, 20 mm, 25 mm, or 30 mm to an upper limit of about 150 mm, 100 mm, 50 mm, 25 mm, 15 mm, or 10 mm, and wherein the length may range from any lower limit to any upper limit and encompass any subset therebetween.

The circumference of organic porous masses may range from a lower limit of about 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, or 26 mm to an upper limit of about 60 mm, 50 mm, 40 mm, 30 mm, 20 mm, 29 mm, 28 mm, 27 mm, 26 mm, 25 mm, 24 mm, 23 mm, 22 mm, 21 mm, 20 mm, 19 mm, 18 mm, 17 mm, or 16 mm, wherein the circumference may range from any lower limit to any upper limit and encompass any subset therebetween.

One skilled in the art would recognize the dimensional requirements for organic porous masses configured for filtration devices other than smoking articles. By way of nonlimiting example, organic porous masses configured for use in concentric fluid filters may be hollow cylinders with an outer diameter of about 250 mm or greater. By way of another nonlimiting example, organic porous masses configure for use as a sheet in an air filter may have a relatively thin thickness (e.g., about 5 mm to about 50 mm) with a length and width that are tens of centimeters.

Some embodiments may involve wrapping organic porous masses with a wrapper after the matrix material has been mechanically bound, e.g., after removal from the mold cavity or exiting an extrusion die. Suitable wrappers include those disclosed above.

Some embodiments may involve cooling organic porous masses. Cooling may be active or passive, i.e., cooling may be assisted or occur naturally. Active cooling may involve passing a fluid over and/or through the mold cavity and/or organic porous masses; decreasing the temperature of the local environment about the mold cavity or organic porous masses, e.g., passing through a refrigerated component; and any combination thereof. Active cooling may involve a component that may include, but not be limited to, cooling coils, fluid jets, thermoelectric materials, and any combination thereof. The rate of cooling may be random or it may be controlled.

Some embodiments may involve transporting organic porous masses to another location. Suitable forms of transportation may include, but not be limited to, conveying, carrying, rolling, pushing, shipping, robotic movement, and the like, and any combination thereof.

One skilled in the art, with the benefit of this disclosure, should understand the plurality of apparatuses and/or systems capable of producing organic porous masses. By way of nonlimiting examples, FIGS. 1-11 illustrate a plurality of apparatuses and/or systems capable of producing organic porous masses.

It should be noted that where a system is used, it is within the scope of this disclosure to have an apparatus with the components of a system, and vice versa.

For ease of understanding, the term "material path" is used herein to identify the path along which matrix material and/or organic porous masses will travel in a system and/or apparatus. In some embodiments, a material path may be contiguous. In some embodiments, a material path may be noncontiguous. By way of nonlimiting example, systems for batch processing with multiple, independent mold cavities may be considered to have a noncontiguous material path.

Figure 1A:
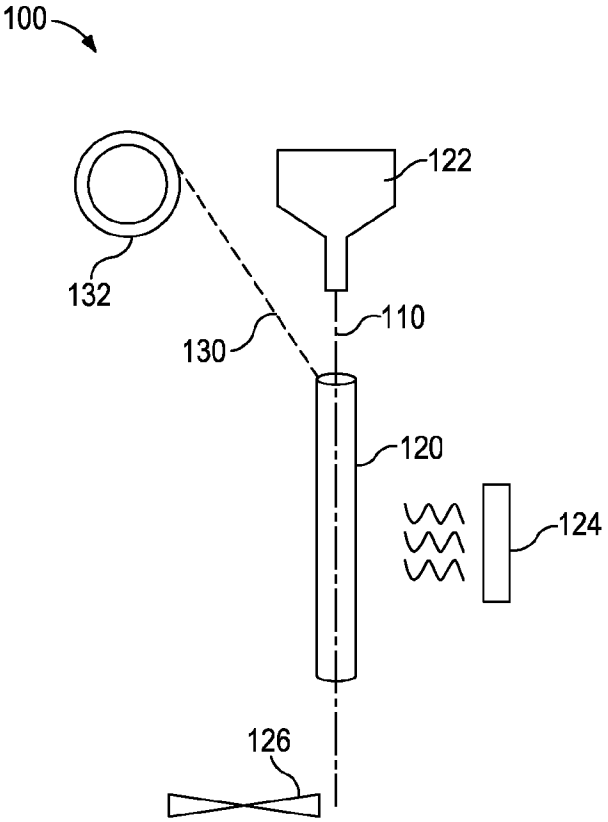

Referring now to FIGS. 1A-B, system 100 may include hopper 122 operably connected to material path 110 to feed the matrix material (not shown) to material path 110. System 100 may also include paper feeder 132 operably connected to material path 110 so as to feed paper 130 into material path 110 to form a wrapper substantially surrounding the matrix material between mold cavity 120 and the matrix material. Heating element 124 is in thermal communication with the matrix material while in mold cavity 120. Heating element 124 may cause the matrix material to mechanically bond at a plurality of points thereby yielding a wrapped organic porous mass length (not shown). After the wrapped organic porous mass length exits mold cavity 120 and is suitably cooled, cutter 126 cuts the wrapped organic porous mass length radially, i.e., perpendicular to the longitudinal axis, thereby yielding wrapped organic porous masses and/or wrapped organic porous mass sections.

FIGS. 1A-B, demonstrate that system 100 may be at any angle. One skilled in the art, with the benefit of this disclosure, should understand the configurational considerations when adjusting the angle at which system 100, or any component thereof, is placed. By way of nonlimiting example, FIG. 1B shows hopper 122 may be configured such that the outlet of hopper 122 (and any corresponding matrix feed device) is within mold cavity 120. In some embodiments, a mold cavity may be at an angle at or between vertical and horizontal.

In some embodiments, feeding matrix material to a material path may involve any suitable feeder system including, but not limited to, hand feeding, volumetric feeders, mass flow feeders, gravimetric feeders, pressurized vessel (e.g., pressurized hopper or pressurized tank), augers or screws, chutes, slides, conveyors, tubes, conduits, channels, and the like, and any combination thereof. In some embodiments, the material path may include a mechanical component between the hopper and the mold cavity including, but not limited to, garnitures, compression molds, flow-through compression molds, ram presses, pistons, shakers, extruders, twin screw extruders, solid state extruders, and the like, and any combination thereof. In some embodiments, feeding may involve, but not be limited to, forced feeding, controlled rate feeding, volumetric feeding, mass flow feeding, gravimetric feeding, vacuum-assisted feeding, fluidized powder feeding, pneumatic dense phase feeding (e.g., via slug flow, dune or irregular dune flow, shearing-bed or ripple flow, and extrusion flow), pneumatic dilute phase feeding, and any combination thereof.

In some embodiments, feeding the matrix material to a material path involving pneumatic dense phase feeding may advantageously allow for high-throughput processing. Pneumatic dense phase feeding has been performed at high flow rates with large diameter outlets, but here has unexpectedly been shown to be effective with small diameters at high speeds. For example, surprisingly, the use of pneumatic dense phase feeding has been demonstrated at small diameters (e.g., about 5 mm to about 25 mm and about 5 mm to about 10 mm) with high-throughput (e.g., about 575 kg/hour or about 500 m/min for a tubing outlet (described further herein) of about 6.1 mm). By comparison gravity feeding typically produces less than about 10 m/min at similar diameters and pneumatic dense phase feeding may be performed at similar speeds with outlets sized at 50 mm or greater. The combination of small diameter and high-throughput for a matrix material, especially a granular or particulate matrix material, has been unexpected. One skilled in the art would recognize the appropriate size and shape for the outlet of a pneumatic dense phase feeding apparatus to accommodate the mold cavity. By way of nonlimiting example, the outlet may be similar in shape to the mold cavity but smaller than the mold cavity and extend into the mold cavity. In another example, the outlet may be shaped to accommodate mold cavities for sheet organic porous masses (e.g., a long, rectangular-shaped outlet) or for hollow cylinder organic porous masses (e.g., a donut-shaped outlet).

Further, the process of pneumatic dense phase feeding may advantageously mitigate particle migration and segregation, which can be especially problematic when the binder and organic particles are sized and/or shaped differently. Without being limited by theory, it is believed that the air pressure applied in the pressurized hopper creates a plug flow of matrix material, which minimizes particulate separation and, consequently, provides for a more homogeneous and consistent matrix material composition at the outlet of the feeder. In some embodiments, the pressurized hopper may be designed for mass flow. Mass flow conditions may depend on, inter alia, the slope of the internal walls of the pressurized hopper, the material of the walls, and the composition of the matrix material.

In some embodiments, the feeding rate of matrix material to a material path may range from a lower limit of about 1 m/min, 10 m/min, 25 m/min, 100 m/min, or 150 m/min to an upper limit of about 800 m/min, 600 m/min, 500 m/min, 400 m/min, 300 m/min, 200 m/min, or 150 m/min, and wherein the feeding rate may range from any lower limit to any upper limit and encompass any subset therebetween. In some embodiments, the feeding rate of matrix material to a material path may range from a lower limit of about 1 m/min, 10 m/min, 25 m/min, 100 m/min, or 150 m/min to an upper limit of about 800 m/min, 600 m/min, 500 m/min, 400 m/min, 300 m/min, 200 m/min, or 150 m/min in combination with a mold cavity having a diameter ranging from a lower limit of about 0.5 mm, 2 mm, 3 mm, 4 mm, 5 mm, or 6 mm to an upper limit of about 10 mm, 9, mm, 8 mm, 7 mm, or 6 mm, and wherein each of the feeding rate and mold cavity diameter may independently range from any lower limit to any upper limit and encompass any subset therebetween. One of ordinary skill in the art should understand that the diameter (or shape) and feeding rate combination achievable may depend on, inter alia, the size and shape of the particles in the matrix material, the other components of the matrix material (e.g., additives), the matrix material permeability and deaeration constant, the distance conveyed (e.g., the length of the tubing, described further herein), the conveying system configuration, and the like, and any combination thereof.

In some embodiments, the pneumatic flow may be characterized by a solid to fluid ratio of about 15 or greater. In some embodiments, the pneumatic flow may be characterized by a solid to fluid ratio ranging from a lower limit of about 15, 20, 30, 40, or 50 to an upper limit of about 500, 400, 300, 200, 150, 130, 100, or 70 and wherein the solid to fluid ratio may range from any lower limit to any upper limit and encompass any subset therebetween. The solid to fluid ratio may depend on, inter alia, the type of pneumatic dense phase feeding where extrusion dense phase feeding occurs typically at higher values.

In some embodiments, pneumatic dense phase feeding may involve applying an air pressure from a lower limit of about 1 psig, 2 psig, 5 psig, 10 psig, or 25 psig to about 150 psig, 125 psig, 100 psig, 50 psig, or 25 psig, and wherein the air pressure may range from any lower limit to any upper limit and encompass any subset therebetween. It should be noted that the air pressure may be applied with a plurality of gases, e.g., an inert gas (e.g., nitrogen, argon, helium, and the like), an oxygenated gas, a heated gas, a dry gas (i.e., less than about 6 ppm water), and the like, and any combination thereof (e.g., a heated, dry, inert gas like nitrogen or argon). Examples of systems that include pneumatic dense phase feeding are included herein.

As described above, some of the organic particles described herein are prone to aggregation. In some embodiments, feeding the matrix material to the mold cavity may be performed in a controlled environment (e.g., low relative humidity) and/or at reduced temperatures to reduce the tendency for the organic particle to agglomerate. Further, feeding methods may be utilized that break-up aggregates and mitigate formation of aggregates, e.g., shear mixing, auger mixing, and the like.

In some embodiments, feeding may be indexed to enable the insertion of a spacer material at predetermined intervals. Suitable spacer materials may comprise additives, solid barriers (e.g., mold cavity parts), porous barriers (e.g., papers and release wrappers), filters, cavities, and the like, and any combination thereof. In some embodiments, feeding may involve shaking and/or vibrating. One skilled in the art, with the benefit of this disclosure, should understand the degree of shaking and/or vibrating that is appropriate, e.g., a homogenously distributed matrix material comprising large binder particles and small organic particles may be adversely affected by vibrating, i.e., homogeneity may be at least partially lost. Further, one skilled in the art should understand the effects of feeding parameters and/or feeders on the final properties of the organic porous masses produced, e.g., the effects on at least void volume (discussed further below), encapsulated pressure drop (discussed further below), and compositional homogeneity.

In some embodiments, the matrix material or components thereof may be dried before being introduced into the material path and/or while along the material path. Drying may be achieved, in some embodiments, with heating the matrix material or components thereof, blowing dry gas over the matrix material or components thereof, and any combination thereof. In some embodiments, the matrix material may have a moisture content of about 10% by weight or less, about 5% by weight or less, or more preferably about 2% by weight or less, and in some embodiments as low as 0.01% by weight. Moisture content may be analyzed by known methods that involve freeze drying or weight loss after drying.

Figure 2B:
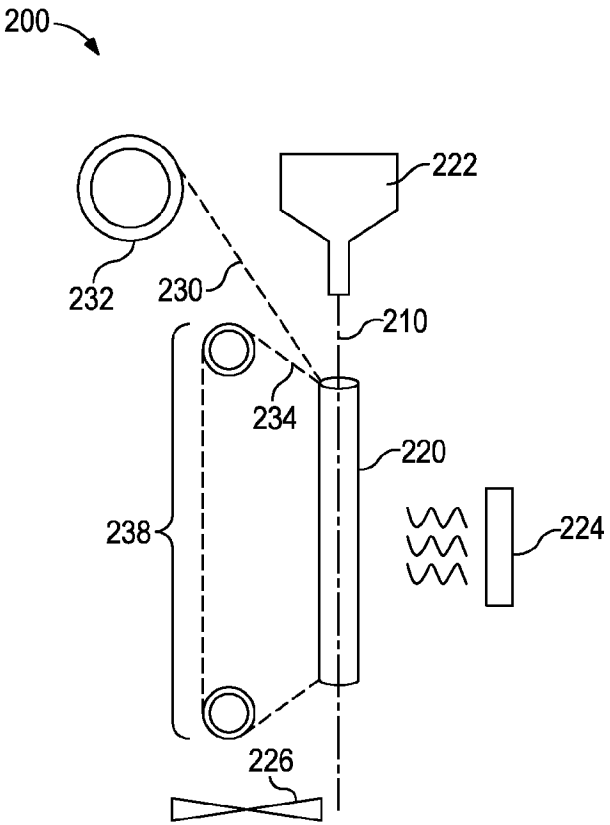
FIGS. 2A-B illustrate nonlimiting examples of systems for forming organic porous masses according to the present invention (not necessarily to scale).
Figure 2A:
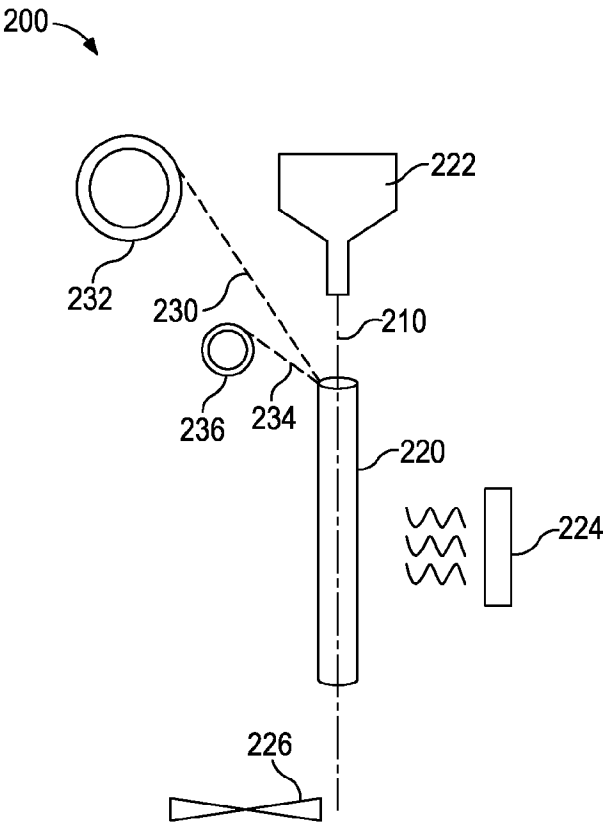

Referring now to FIGS. 2A-B, system 200 may include hopper 222 operably connected to material path 210 to feed the matrix material to material path 210. System 200 may also include paper feeder 232 operably connected to material path 210 so as to feed paper 230 into material path 210 to form a wrapper substantially surrounding the matrix material between mold cavity 220 and the matrix material. Further, system 200 may include release feeder 236 operably connected to material path 210 so as to feed release wrapper 234 into material path 210 to form a wrapper between paper 230 and mold cavity 220. In some embodiments, release feeder 236 may be configured as conveyor 238 that continuously cycles release wrapper 234. Heating element 224 is in thermal communication with the matrix material while in mold cavity 220. Heating element 224 may cause the matrix material to mechanically bond at a plurality of points thereby yielding a wrapped organic porous mass length. After the wrapped organic porous mass length exits mold cavity 220 and is suitably cooled, cutter 226 cuts the wrapped organic porous mass length radially thereby yielding wrapped organic porous masses and/or wrapped organic porous mass sections. In embodiments where release wrapper 234 is not configured as conveyor 238, release wrapper 234 may be removed from the wrapped organic porous mass length before cutting or from the wrapped organic porous masses and/or wrapped organic porous mass sections after cutting.

Figure 3:
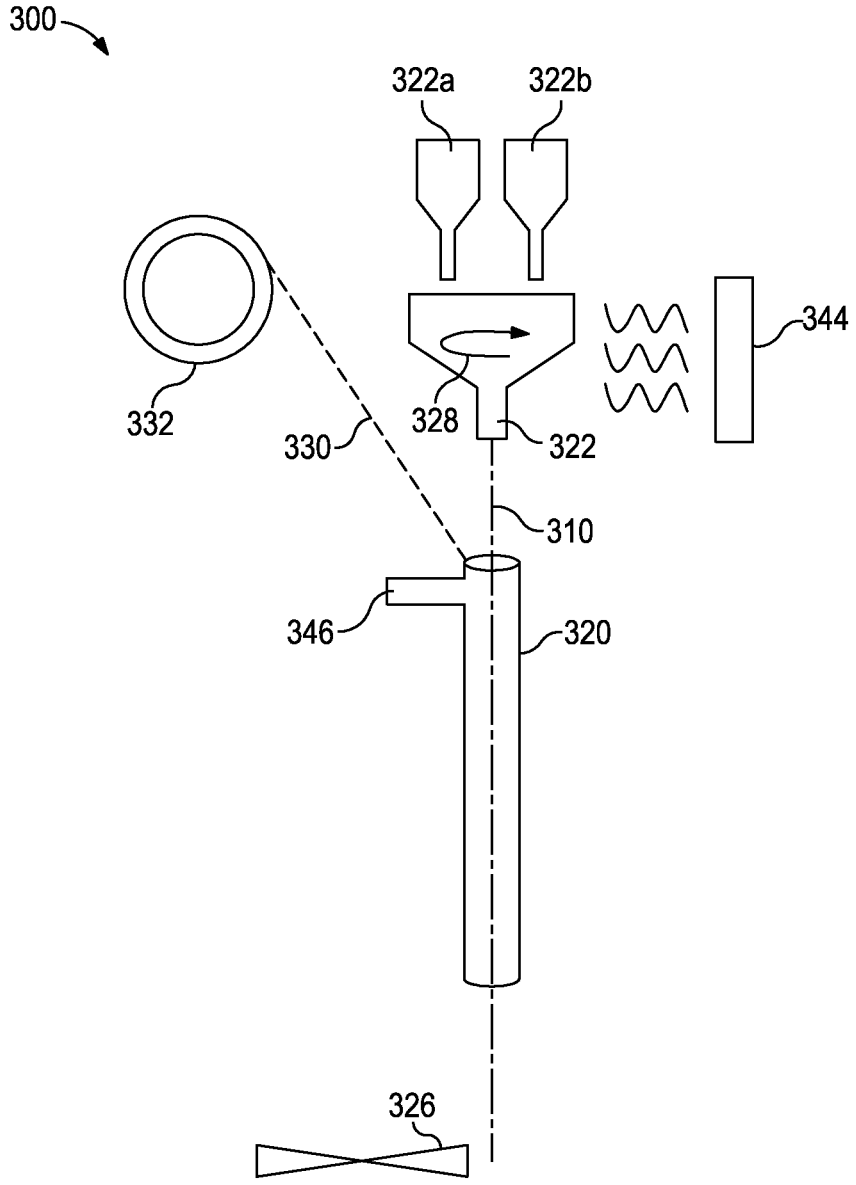
FIG. 3 illustrates a nonlimiting example of a system for forming organic porous masses according to the present invention (not necessarily to scale).

Referring now to FIG. 3, system 300 may include component hoppers 322*a* and 322*b* that feed components of the matrix material into hopper 322. The matrix material may be mixed and preheated in hopper 322 with mixer 328 and preheater 344. Hopper 322 may be operably connected to material path 310 to feed the matrix material to material path 310. System 300 may also include paper feeder 332 operably connected to material path 310 so as to feed paper 330 into material path 310 to form a wrapper substantially surrounding the matrix material between mold cavity 320 and the matrix material. Mold cavity 320 may include fluid connection 346 through which heated fluid (liquid or gas) may pass into material path 310 and mechanically bond the matrix material at a plurality of points thereby yielding a wrapped organic porous mass length. It should be noted that fluid connection 346 can be located at any location along mold cavity 320 and that more than one fluid connection 346 may be disposed along mold cavity 320. After the wrapped organic porous mass length exits mold cavity 320 and is suitably cooled, cutter 326 cuts the wrapped organic porous mass length radially thereby yielding wrapped organic porous masses and/or wrapped organic porous mass sections.

One skilled in the art with the benefit of this disclosure should understand that preheating can also take place for individual feed components before hopper 322 and/or with the mixed components after hopper 322.

Suitable mixers may include, but not be limited to, ribbon blenders, paddle blenders, plow blenders, double cone blenders, twin shell blenders, planetary blenders, fluidized blenders, high intensity blenders, rotating drums, blending screws, rotary mixers, and the like, and any combination thereof.

In some embodiments, component hoppers may hold individual components of the matrix material, e.g., two component hoppers with one holding binder particles and the other holding organic particles. In some embodiments, component hoppers may hold mixtures of components of the matrix material, e.g., two component hoppers with one holding a mixture of binder particles and organic particles and the other holding an additive like a vitamin. In some embodiments, the components within component hoppers may be solids, liquids, gases, or combinations thereof. In some embodiments, the components of different component hoppers may be added to the hopper at different rates to achieve a desired blend for the matrix material. By way of nonlimiting example, three component hoppers may separately hold organic particles, binder particles, and dyes or pigments (additives described further below) in liquid form. Binder particles may be added to the hopper at twice the rate of the organic particles, and the dyes or pigments may be sprayed in so as to form at least a partial coating on both the organic particles and the binder particles.

In some embodiments, fluid connections to mold cavities may be to pass a fluid into the mold cavity, pass a fluid through a mold cavity, and/or drawing on a mold cavity. As used herein, the term "drawing" refers to creating a negative pressure drop across a boundary and/or along a path, e.g., sucking. Passing a heated fluid into and/or through a mold cavity may assist in mechanically bonding the matrix material therein. Drawing on a mold cavity that has a wrapper disposed therein may assist in lining the mold cavity evenly, e.g., with less wrinkles.

Figure 4:
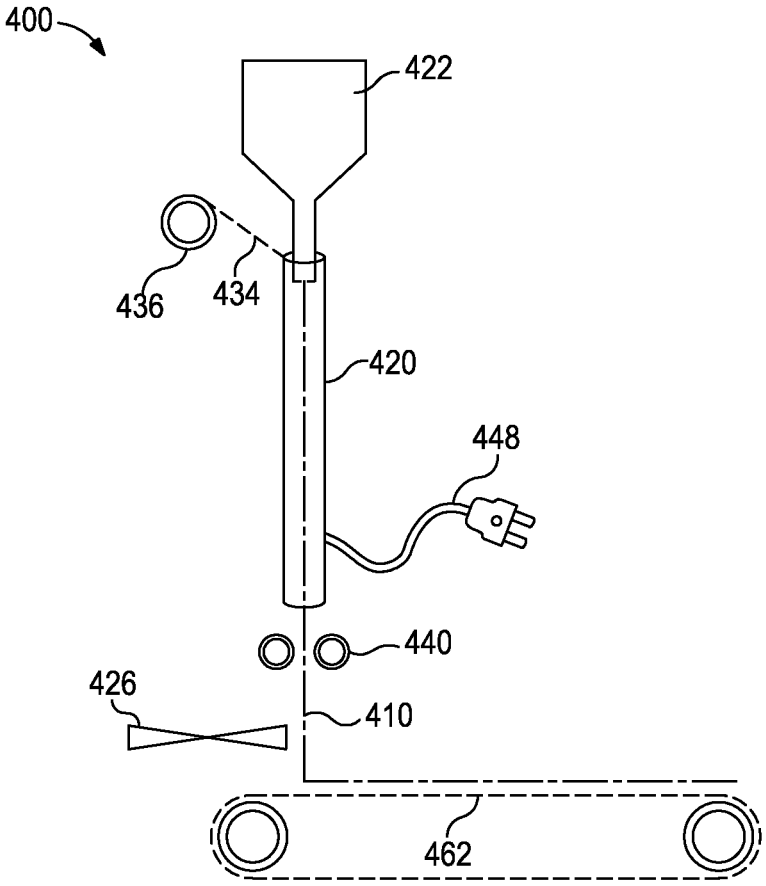
FIG. 4 illustrates a nonlimiting example of a system for forming organic porous masses according to the present invention (not necessarily to scale).

Referring now to FIG. 4, system 400 may include hopper 422 operably connected to material path 410 to feed the matrix material to material path 410. Hopper 422 may be configured along material path 410 such that the outlet of hopper 422, or an extension from its outlet, is within mold cavity 420. This may advantageously allow for the matrix material to be fed into mold cavity 420 at a rate to control the packing of the matrix material and consequently the void volume of resultant organic porous masses. In this nonlimiting example, mold cavity 420 comprises a thermoelectric material and therefore includes power connection 448. System 400 may also include release feeder 436 operably connected to material path 410 so as to feed release wrapper 434 into material path 410 to form a wrapper substantially surrounding the matrix material between mold cavity 420 and the matrix material. Mold cavity 420 may be made of a thermoelectric material so that mold cavity 420 may provide the heat to mechanically bond the matrix material at a plurality of points thereby yielding a wrapped organic porous mass length. Along material path 410 after mold cavity 420, roller 440 may be operably capable of assisting the movement of the wrapped organic porous mass length through mold cavity 420. After the wrapped organic porous mass length exits mold cavity 420 and is suitably cooled, cutter 426 cuts the wrapped organic porous mass length radially thereby yielding wrapped organic porous masses and/or wrapped organic porous mass sections. After cutting, the organic porous masses continue along material path 410 on organic porous mass conveyor 462, e.g., for packaging or further processing. Release wrapper 434 may be removed from the wrapped organic porous mass length before cutting or from the wrapped organic porous masses and/or wrapped organic porous mass sections after cutting.

Suitable rollers and/or substitutes for rollers may include, but not be limited to, cogs, cogwheels, wheels, belts, gears, and the like, and any combination thereof. Further rollers and the like may be flat, toothed, beveled, and/or indented.

Figure 5:
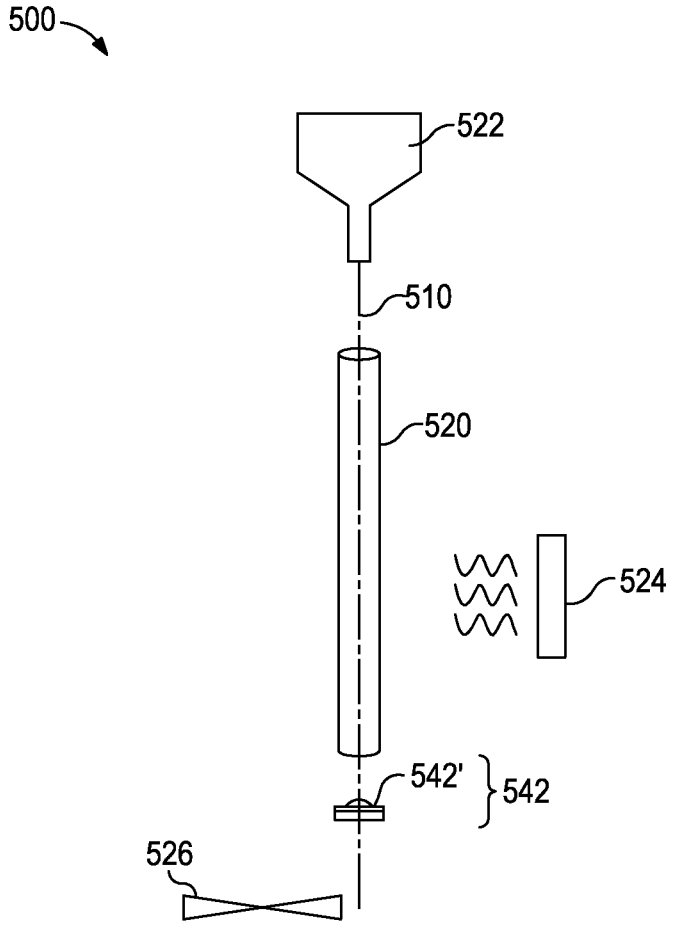
FIG. 5 illustrates a nonlimiting example of a system for forming organic porous masses according to the present invention (not necessarily to scale).

Referring now to FIG. 5, system 500 may include hopper 522 operably connected to material path 510 to feed the matrix material to material path 510. Heating element 524 is in thermal communication with the matrix material while in mold cavity 520. Heating element 524 may cause the matrix material to mechanically bond at a plurality of points, thereby yielding an organic porous mass length. After the organic porous mass length exits mold cavity 520, die 542 may be used for extruding the organic porous mass length into a desired cross-sectional shape. Die 542 may include a plurality of dies 542' (e.g., multiple dies or multiple holes within a single die) through which the organic porous mass length may be extruded. After the organic porous mass length is extruded through die 542 and suitably cooled, cutter 526 cuts the organic porous mass length radially, thereby yielding organic porous masses and/or organic porous mass sections.

Figure 6A:
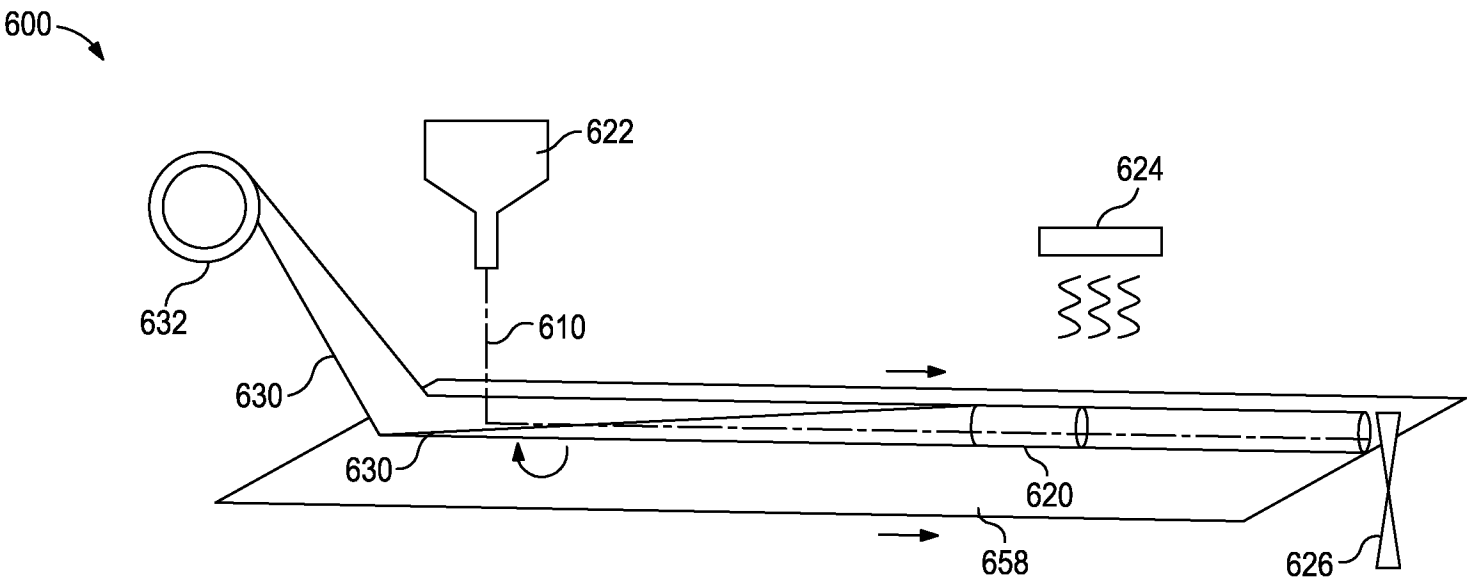
FIG. 6A illustrates a nonlimiting example of a system for forming organic porous masses according to the present invention (not necessarily to scale).

Referring now to FIG. 6A, system 600 may include paper feeder 632 operably connected to material path 610 so as to feed paper 630 into material path 610. Hopper 622 (or other matrix material delivery apparatus, e.g., an auger) may be operably connected to material path 610 so as to place matrix material on paper 630. Paper 630 may wrap around the matrix material, at least in part, because of passing-through mold cavity 620 (or compression mold sometimes referred to a garniture device in relation to cigarette filter forming apparatuses), which provide the desired cross-sectional shape (or optional, in some embodiments, the matrix material may be combined with paper 630 after formation of the desired cross-section has begun or is complete). In some embodiments, the paper seam may be glued. Heating element 624 (or alternatively an electromagnetic radiation source, e.g., a microwave source, a convection oven, a heating block, and the like, or hybrids thereof) is in thermal communication with the matrix material while and/or after being in mold cavity 620. Heating element 624 may cause the matrix material to mechanically bond at a plurality of points, thereby yielding a wrapped organic porous mass length. After the wrapped organic porous mass length exits mold cavity 620 and is suitably cooled, cutter 626 cuts the wrapped organic porous mass length radially, thereby yielding wrapped organic porous masses and/or wrapped organic porous mass sections. Movement through system 600 may be aided by conveyor 658 with mold cavity 620 being stationary. It should be noted that while not shown, a similar embodiment may include paper 630 as part of a looped conveyor that unwraps from the organic porous mass length before cutting, which would yield organic porous masses and/or organic porous mass sections.

Figure 6B:
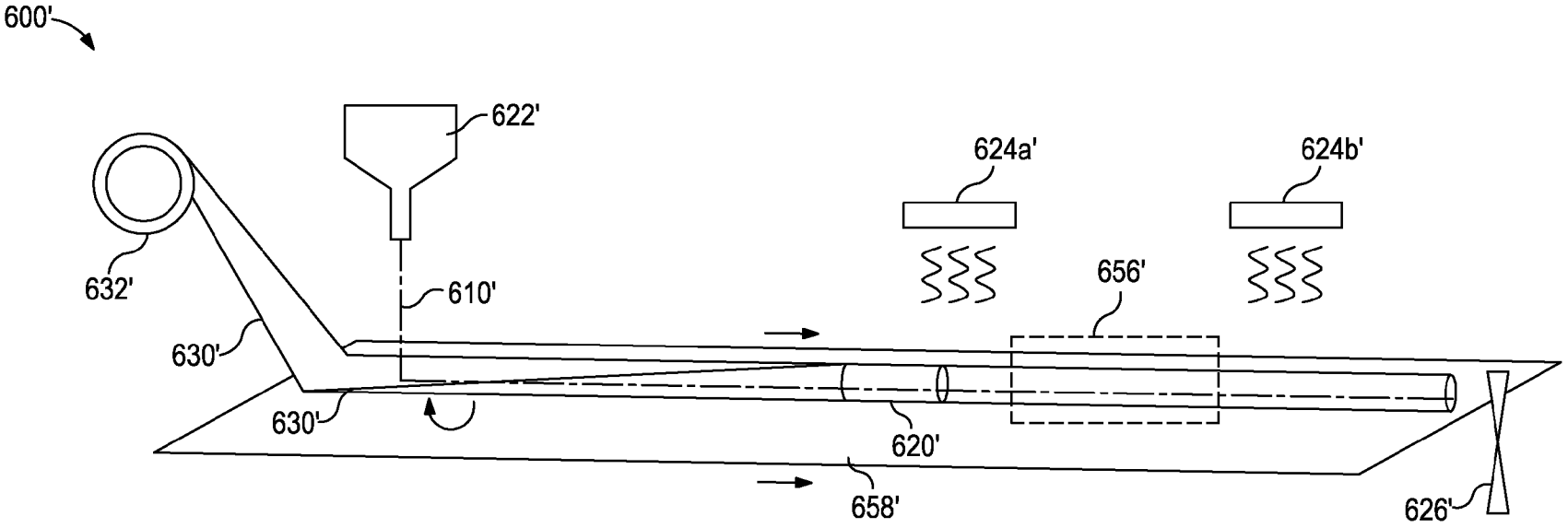
FIG. 6B illustrates a nonlimiting example of a system for forming organic porous masses according to the present invention (not necessarily to scale).

Referring now to FIG. 6B, system 600' may include paper feeder 632' operably connected to material path 610' so as to feed paper 630' into material path 610'. Hopper 622' (or other matrix material delivery apparatus, e.g., an auger) may be operably connected to material path 610' so as to place matrix material on paper 630'. Paper 630' may wrap around the matrix material, at least in part, because of passing-through mold cavity 620' (e.g., a compression mold sometimes referred to a garniture device in relation to cigarette filter forming apparatuses), which provide the desired cross-sectional shape (or optional, in some embodiments, the matrix material may be combined with paper 630' after formation of the desired cross-section has begun or is complete). In some embodiments, the paper seam may be glued.

System 600' may comprise more than one heating element 624'. The first heating element **624*a'* is in thermal communication with the matrix material while and/or after being in mold cavity 620', and may cause at least a portion of the matrix material to mechanically bond at a plurality of points (e.g., form sintered contact points). The organic porous mass length may then be sized to a desired cross-sectional shape or size with compression mold 656' (e.g., for reshaping the cross-sectional shape the wrapped porous mass length) and then reheated with a second heating element 624***b*' (which may be a heating element similar to that of the first heating element 624*a*', e.g., both microwaves, or different, e.g., first a microwave and second an oven) to form additional mechanical bonding (e.g., sintered contact point). Optionally, not shown, the wrapped organic porous mass length after the second heating element 624*b*' may again be sized to a desired cross-sectional shape or size. The resultant wrapped organic porous mass length may then be suitably cooled, radially cut with cutter 626 into wrapped organic porous masses and/or wrapped organic porous mass sections. Movement through system 600' may be aided by conveyor 658' with mold cavity 620' being stationary.

In some instances, depending on the degree of the first sintering or heating step, the organic porous mass length may be cooled and cut, then, reheated. One skilled in the art would recognize how to modify the other systems and methods described herein to provide for two or more sintering (or heating) steps.

In some embodiments, while the matrix material is at an elevated temperature, the porous mass or the like may be resized and/or reshaped with the application of pressure. Compression molding may consist of a driven or non-driven sizing or forming roller, a series of rollers, or a die or series of dies, and any combination thereof suitable for bringing the rod to final shape or dimension. Resizing and/or reshaping may be performed after each heating step of the method.

Figure 7A:
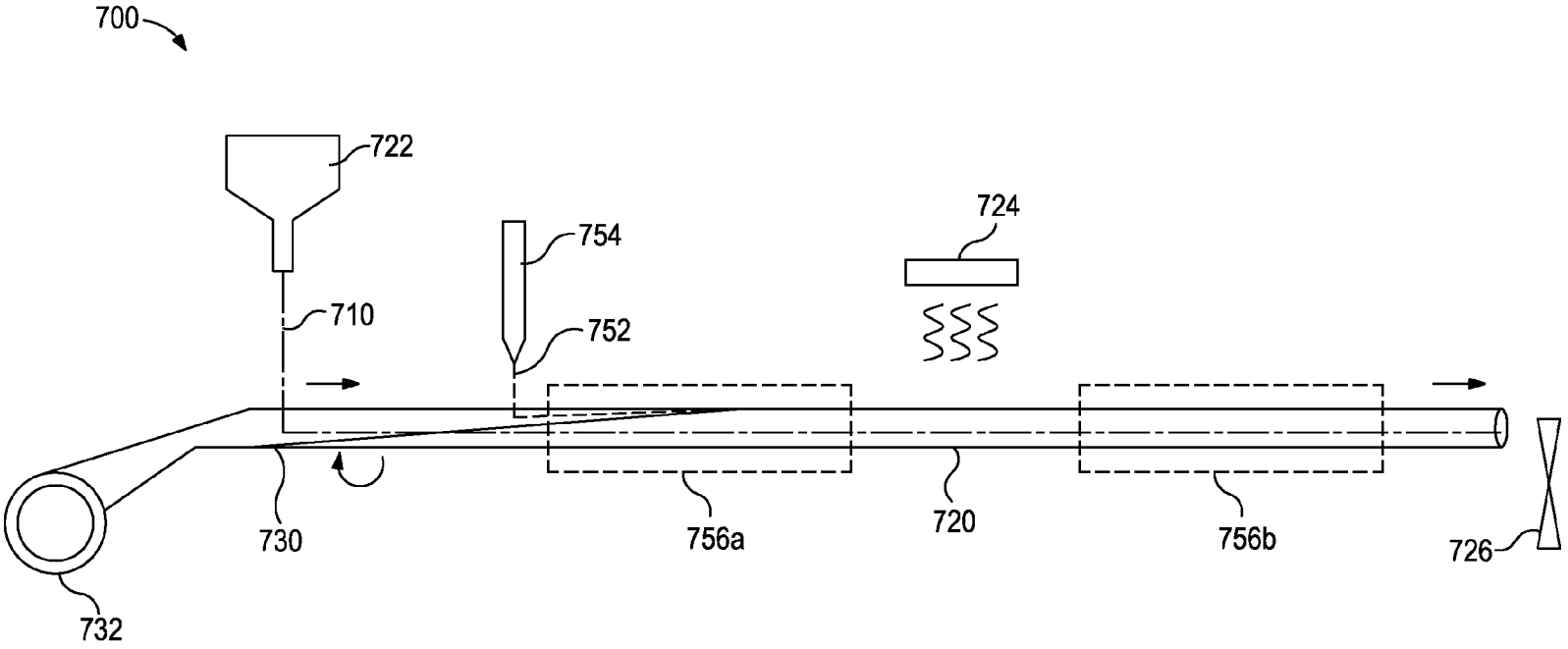
FIG. 7A illustrates a nonlimiting example of a system for forming organic porous masses according to the present invention (not necessarily to scale).

Referring now to FIG. 7A, system 700 may include paper feeder 732 operably connected to material path 710 so as to feed paper 730 into material path 710. As shown, mold cavity 720, a cylindrically-rolled paper glued at the longitudinal seam, may be formed on-the-fly with forming mold 756*a* (or forming mold sometimes referred to a garniture device, including paper tube folders, in relation to cigarette filter forming apparatuses) causing paper 730 to roll with glue 752 applied with glue-application device 754 (e.g., a glue gun), optionally followed by a glue seam heater (not shown). During the formation of mold cavity 720, matrix material may be introduced along material path 710 from hopper 722. Heating element 724 (e.g., a microwave source, a convection oven, a heating block, and the like, or hybrids thereof) in thermal communication with mold cavity 720 may cause the matrix material to mechanically bond at a plurality of points thereby yielding a wrapped organic porous mass length. Then, compression mold 756*b* may be used before complete cooling of the matrix material to size the wrapped organic porous mass length into a desired cross-sectional size, which may advantageously be used for uniformity in the circumference and shape (e.g., ovality) of the wrapped organic porous mass. After the wrapped organic porous mass length is suitably cooled, cutter 726 cuts the wrapped organic porous mass length radially, thereby yielding wrapped organic porous masses and/or wrapped organic porous mass sections. Movement through system 700 may be aided by rollers, conveyors, or the like, not shown. One skilled in the art with the benefit of this disclosure should understand that the processes described may occur in a single apparatus or in multiple apparatus. For example, rolling the paper, introducing the matrix material, exposing to heat (e.g., by applying microwaves or heating in a conventional oven), and resizing may be performed in a single apparatus and the resultant organic porous mass length may be conveyed to a second apparatus for cutting. System 700 may be oriented in any direction, for example, vertical or horizontal or anywhere in between.

In some embodiments, while the matrix material is at an elevated temperature, the organic porous mass or the like may be resized and/or reshaped with the application of pressure.

In some embodiments, glue or other adhesives used to seal a paper mold cavity (or other flexible mold cavity material like plastics) may be a cold melt adhesive, a hot melt adhesive, a pressure sensitive adhesive, a curable adhesive, and the like. Cold melt adhesives may be preferred so as to mitigate failure of the glue during a subsequent heating process (e.g., during sintering).

Figure 7B:
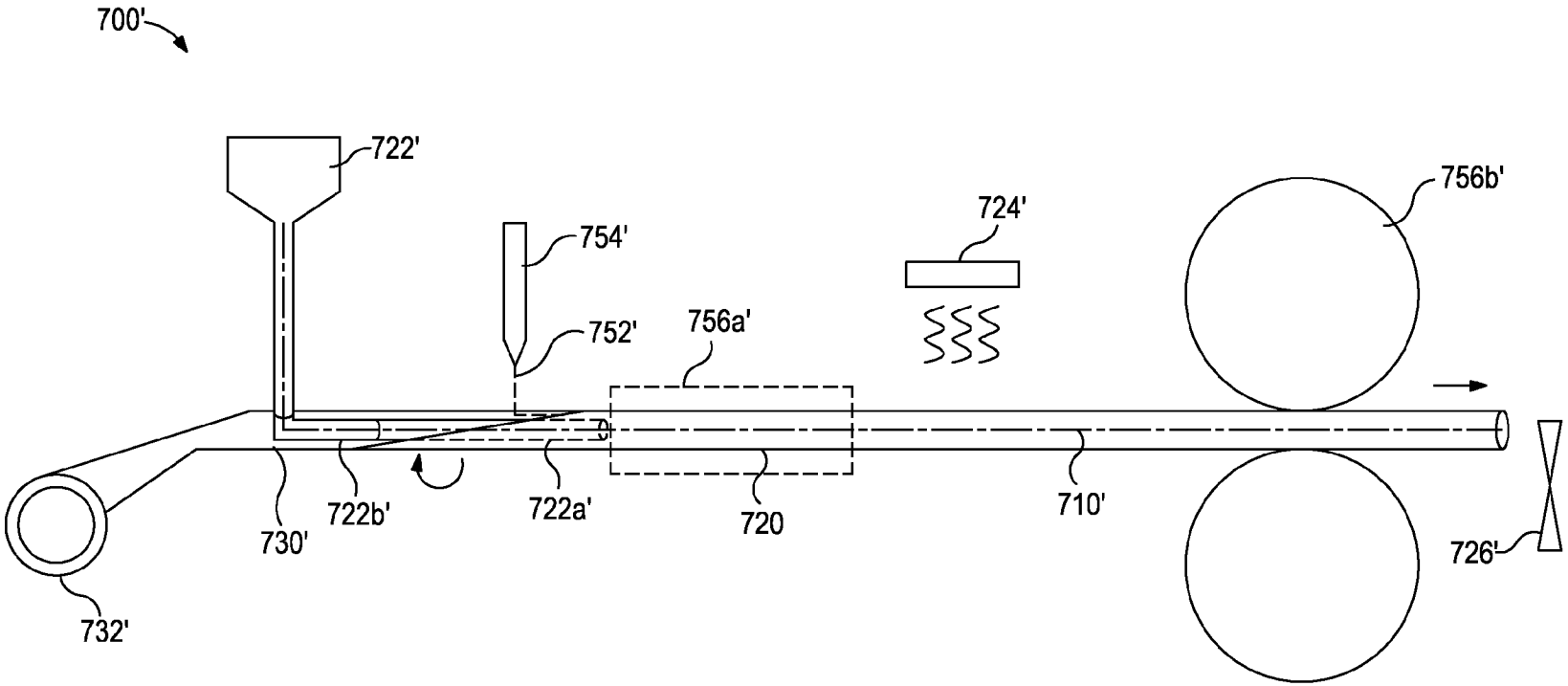
FIG. 7B illustrates a nonlimiting example of a system for forming organic porous masses according to the present invention (not necessarily to scale).

Referring now to FIG. 7B, system 700' may include paper feeder 732' operably connected to material path 710' so as to feed paper 730' into material path 710'. As shown, mold cavity 720', a cylindrically-rolled paper glued at the longitudinal seam, may be formed on-the-fly with forming mold 756*a*' (or forming mold sometimes referred to a garniture device, including paper tube folders, in relation to cigarette filter forming apparatuses) causing paper 730' to roll with glue 752' applied with glue-application device 754' (e.g., a glue gun). During the formation of mold cavity 720', matrix material may be introduced along material path 710' from hopper 722' (e.g., a pressurized hopper of a pneumatic dense phase feeder) operably connected to tubing 722*a*' by joint 722*b*', which may be a flexible joint. Heating element 724' (e.g., a microwave source, a convection oven, a heating block, and the like, or hybrids thereof) in thermal communication with mold cavity 720' (as shown in close proximity to the end of tubing 722*a*') may cause the matrix material to mechanically bond at a plurality of points thereby yielding a wrapped organic porous mass length. Then, compression mold 756*b*' (shown as rollers) may be cooled to assist in the cooling of the matrix material while shaping the wrapped organic porous mass length into a desired more uniform circumference and shape (e.g., ovality). After the wrapped organic porous mass length is suitably cooled, cutter 726' cuts the wrapped organic porous mass length radially, thereby yielding wrapped organic porous masses and/or wrapped organic porous mass sections.

In some embodiments, a mold cavity may be non-porous or varying degrees of porosity to allow for removal of fluid from the matrix material. Further, the forming mold and/or material path may be operably connected to passageways to allow fluid passage from the porous paper in desired orientation. In some instances, these fluid passages may be connected to a source below atmospheric pressure. Removal of fluid from the mix may, in some embodiments, improve system run-ability and minimize matrix material particle segregation.

In some embodiments, a feeder may include an elongated portion designed to fit into the mold cavity. In some embodiments, the outlet of a feeder (e.g., the outlet of tubing 722*a*') may be sized to be slightly smaller (e.g., about 5% smaller) than the inner diameter of the mold cavity. Further, the feeder or elongated portion thereof may include a flexible portion that allows the outlet to move within the mold cavity. During pneumatic dense phase feeding, such movement may be advantageous by allowing for the outlet to move within the mold cavity. Such movement may advantageously allow the outlet to freely find the center in the mold cavity, which may provide for a fit that enhances run-ability and minimizes matrix mix segregation. In some embodiments, a feeder (e.g., the outlet of tubing 722*a*') may terminate before forming mold 756*a*', within forming mold 756*a*', or after forming mold 756*a*' and optionally after a glue seem heater.

Further, the outlet may, in some embodiments, be designed to have a variable cross-sectional area, which may be advantageous in pneumatic dense phase feeding to aid matrix mix packing density, to minimize particle segregation, and to allow for varying pressures and flow rates in a single system.

In some embodiments, the outlet may be vented with a mesh that does not allow matrix material to flow therethrough but does allow for fluid to pass therethrough. Such ventilation may allow for the pressure to dissipate in a controlled manner over a longer length and mitigate significant particle migration (which may lead to matrix material inhomogeneity) as the matrix material exits the outlet, especially at high flow rates and high pressures.

Figure 8:
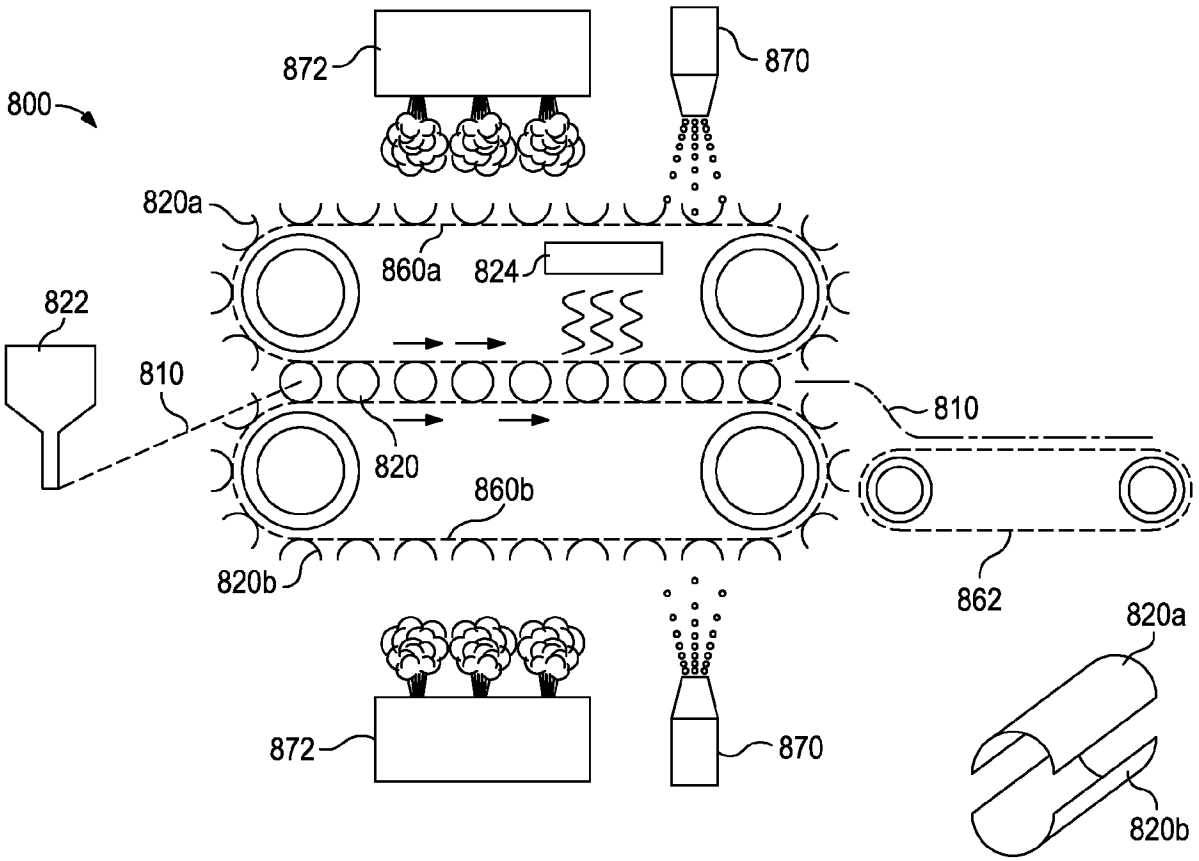
FIG. 8 illustrates a nonlimiting example of a system for forming organic porous masses according to the present invention (not necessarily to scale).

Referring now to FIG. 8, mold cavity 820 of system 800 may be formed from mold cavity parts 820*a* and 820*b* operably connected to mold cavity conveyors 860*a* and 860*b*, respectively. Once mold cavity 820 is formed, matrix material may be introduced along material path 810 from hopper 822. Heating element 824 is in thermal communication with the matrix material while in mold cavity 820. Heating element 824 may cause the matrix material to mechanically bond at a plurality of points, thereby yielding an organic porous mass. After mold cavity 820 is suitably cooled and separated into mold cavity parts 820*a* and 820*b*, the organic porous mass may be removed from mold cavity parts 820*a* and/or 820*b* and continue along material path 810 via an organic porous mass conveyor 862. It should be noted that FIG. 8 illustrates a nonlimiting example of a noncontiguous material path.

In some embodiments, removing organic porous masses from mold cavities and/or mold cavity parts may involve pulling mechanisms, pushing mechanisms, lifting mechanisms, gravity, any hybrid thereof, and any combination thereof. Removing mechanisms may be configured to engage organic porous masses at the ends, along the side(s), and any combination thereof. Suitable pulling mechanisms may include, but not be limited to, suction cups, vacuum components, tweezers, pincers, forceps, tongs, grippers, claws, clamps, and the like, and any combination thereof. Suitable pushing mechanisms may include, but not be limited to, ejectors, punches, rods, pistons, wedges, spokes, rams, pressurized fluids, and the like, and any combination thereof. Suitable lifting mechanisms may include, but not be limited to, suction cups, vacuum components, tweezers, pincers, forceps, tongs, grippers, claws, clamps, and the like, and any combination thereof. In some embodiments, mold cavities may be configured to operably work with various removal mechanisms. By way of nonlimiting example, a hybrid push-pull mechanism may include pushing longitudinally with a rod, so as to move the organic porous mass partially out the other end of the mold cavity, which can then be engaged by forceps to pull the organic porous mass from the mold cavity.

Figure 9:
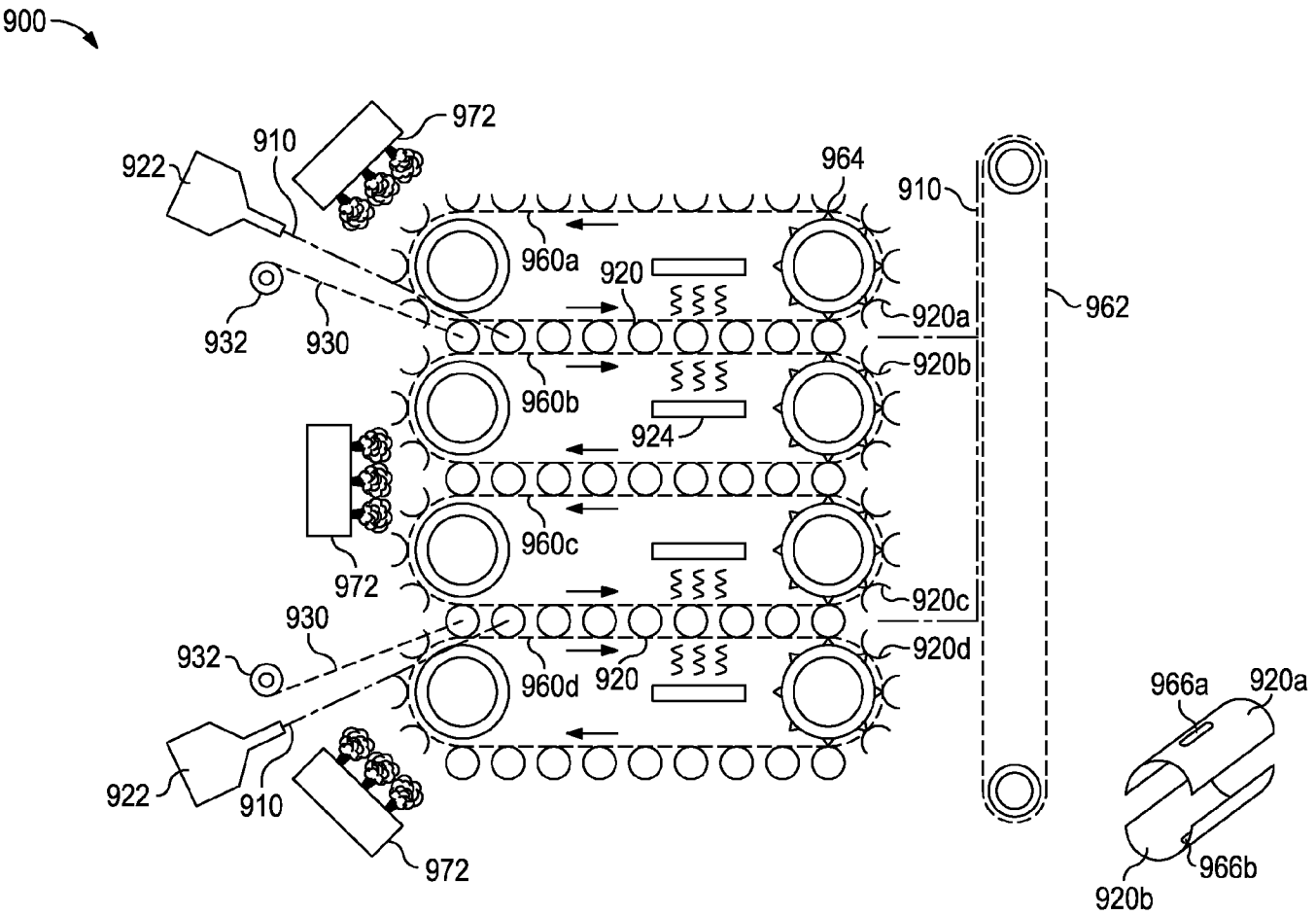
FIG. 9 illustrates a nonlimiting example of a system for forming organic porous masses according to the present invention (not necessarily to scale).
Figure 10:
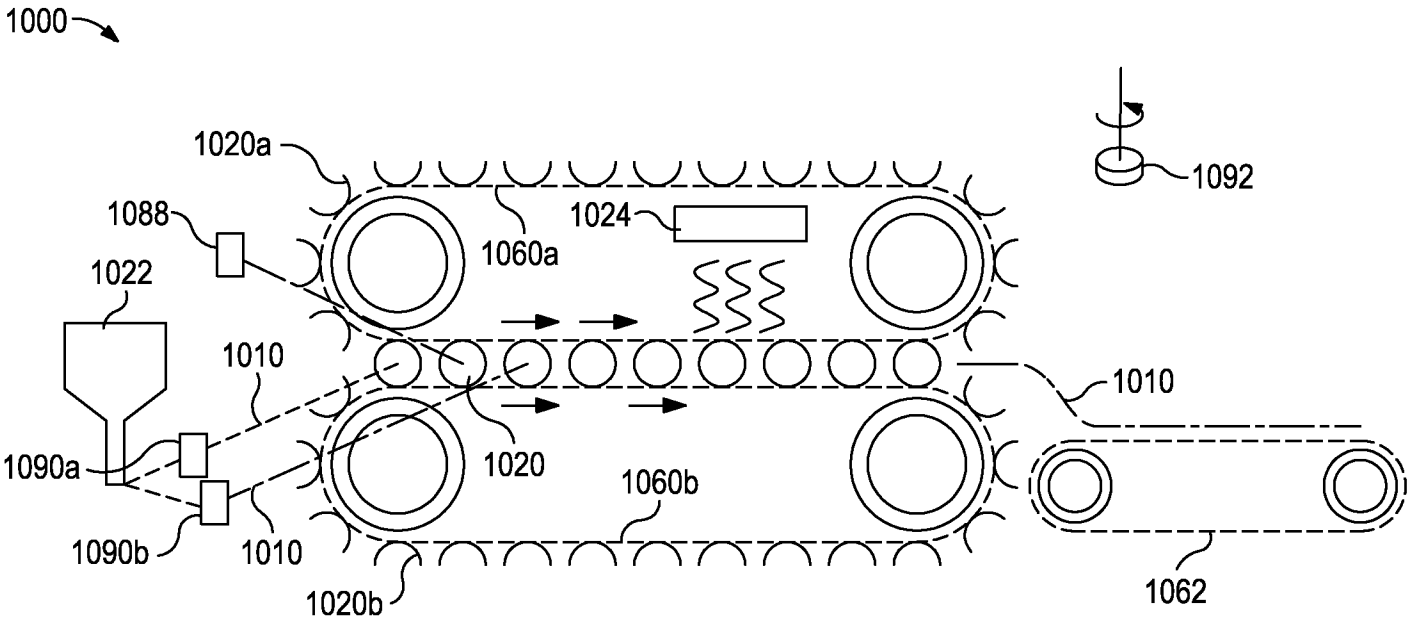
FIG. 10 illustrates a nonlimiting example of a system for forming organic porous masses according to the present invention (not necessarily to scale).

Referring now to FIG. 9, mold cavity 920 of system 900 is formed from mold cavity parts 920*a* and 920*b* or 920*c* and 920*d* operably connected to mold cavity conveyors 960*a*, 960*b*, 960*c*, and 960*d*, respectively. Once mold cavity 920 is formed, or during forming, sheets of paper 930 are introduced into mold cavity 920 via paper feeder 932. Then matrix material is introduced into paper 930 from hopper 922 along material path 910 lined mold cavity 920 and mechanically bound into organic porous masses with heat from heating element 924. After suitable cooling, removal of the organic porous masses may be achieved by insertion of ejector 964 into ejector ports 966*a* and 966*b* of mold cavity parts 920*a*, 920*b*, 920*c*, and 920*d*. The organic porous masses may then continue along material path 910 via an organic porous mass conveyor 962. Again, FIG. 9 illustrates a nonlimiting example of a noncontiguous material path.

Quality control of organic porous mass production may be assisted with cleaning of mold cavities and/or mold cavity parts. Referring again to FIG. 8, cleaning instruments may be incorporated into system 800. As mold cavity parts 820*a* and 820*b* return from forming organic porous masses, mold cavity parts 820*a* and 820*b* pass a series of cleaners including liquid jet 870 and air or gas jet 872. Similarly in FIG. 9, as mold cavity parts 960*a*, 960*b*, 960*c*, and 960*d* return from forming organic porous masses, mold cavity parts 960*a*, 960*b*, 960*c*, and 960*d* pass a series of cleaners that include heat from heating element 924 and air or gas jet 972.

Other suitable cleaners may include, but not be limited to, scrubbers, brushes, baths, showers, insert fluid jets (tubes that insert into mold cavities capable of jetting fluids radially), ultrasonic apparatuses, and any combination thereof.

In some embodiments, organic porous mass sections, organic porous masses, and/or organic porous mass lengths may comprise cavities. By way of nonlimiting example, referring now to FIG. 10, mold cavity parts 1020*a* and 1020*b* operably connected to mold cavity conveyors 1060*a* and 1060*b* operably connect to form mold cavity 1020 of system 1000. Hopper 1022 is operably attached to two volumetric feeders 1090*a* and 1090*b* such that each volumetric feeder 1090*a* and 1090*b* fills mold cavity 1020 partially with the matrix material along material path 1010. Between the addition of matrix material from volumetric feeder 1090*a* and volumetric feeder 1090*b*, injector 1088 places a capsule (not shown) into mold cavity 1020, thereby yielding a capsule surrounded by matrix material. Heating element 1024, in thermal contact with mold cavity 1020, causes the matrix material to mechanically bond at a plurality of points, thereby yielding an organic porous mass with a capsule disposed therein. After the organic porous mass is formed and suitably cooled, rotary grinder 1092 is inserted into mold cavity 1020 along the longitudinal direction of mold cavity 1020. Rotary grinder 1092 is operably capable of grinding the organic porous mass to a desired length in the longitudinal direction. After mold cavity 1020 separates into mold cavity parts 1020*a* and 1020*b*, the organic porous mass is removed from mold cavity parts 1020*a* and/or 1020*b* and continues along material path 1010 via organic porous mass conveyor 1062.

Suitable capsules for use within organic porous masses and the like may include, but not be limited to, polymeric capsules, porous capsules, ceramic capsules, and the like. Capsules may be filled with an additive, e.g., granulated carbon or a flavorant (more examples provided below). The capsules, in some embodiments, may also contain a molecular sieve that reacts with selected components in the smoke to remove or reduce the concentration of the components without adversely affecting desirable flavor constituents of the smoke. In some embodiments, the capsules may include tobacco as an additional flavorant. One should note that if the capsule is insufficiently filled with a chosen substance, in some filter embodiments, this may create a lack of interaction between the components of the mainstream smoke and the substance in the capsules.

One skilled in the art, with the benefit of this disclosure, should understand that other methods described herein may be altered to produce organic porous masses with capsules therein. In some embodiments, more than one capsule may be within an organic porous mass (e.g., an organic porous mass length may be produced in a continuous process with a plurality of capsules therein).

In some embodiments, the shape, e.g., length, width, diameter, and/or height, of organic porous masses may be adjusted by operations other than cutting including, but not limited to, sanding, milling, grinding, smoothing, polishing, rubbing, and the like, and any combination thereof. Generally, these operations will be referred to herein as grinding. Some embodiments may involve grinding the sides and/or ends of organic porous masses to achieve smooth surfaces, roughened surfaces, grooved surfaces, patterned surfaces, leveled surfaces, and any combination thereof. Some embodiments may involve grinding the sides and/or ends of organic porous masses to achieve desired dimensions within specification limitations. Some embodiments may involve grinding the sides and/or ends of organic porous masses while in or exiting mold cavities, after cutting, during further processing, and any combination thereof. One skilled in the art should understand that dust, particles, and/or pieces may be produced from grinding. As such, grinding may involve removing the dust, particles, and/or pieces by methods like vacuuming, blowing gases, rinsing, shaking, and the like, and any combination thereof.

Any component and/or instrument capable of achieving the desired level of grinding may be used in conjunction with systems and methods disclosed herein. Examples of suitable components and/or instruments capable of achieving the desired level of grinding may include, but not be limited to, lathes, rotary sanders, brushes, polishers, buffers, etchers, scribes, and the like, and any combination thereof.

In some embodiments, the organic porous mass may be machined to be lighter in weight, if desired, for example, by drilling out a portion of the organic porous mass.

One skilled in the art, with the benefit of this disclosure, should understand the component and/or instrument configurations necessary to engage organic porous masses at various points with the systems described herein. By way of nonlimiting example, grinding instruments and/or drilling instruments used while organic porous masses are in mold cavities (or organic porous mass lengths are leaving mold cavities) should be configured so as not to deleteriously affect the mold cavity.

Figure 11:
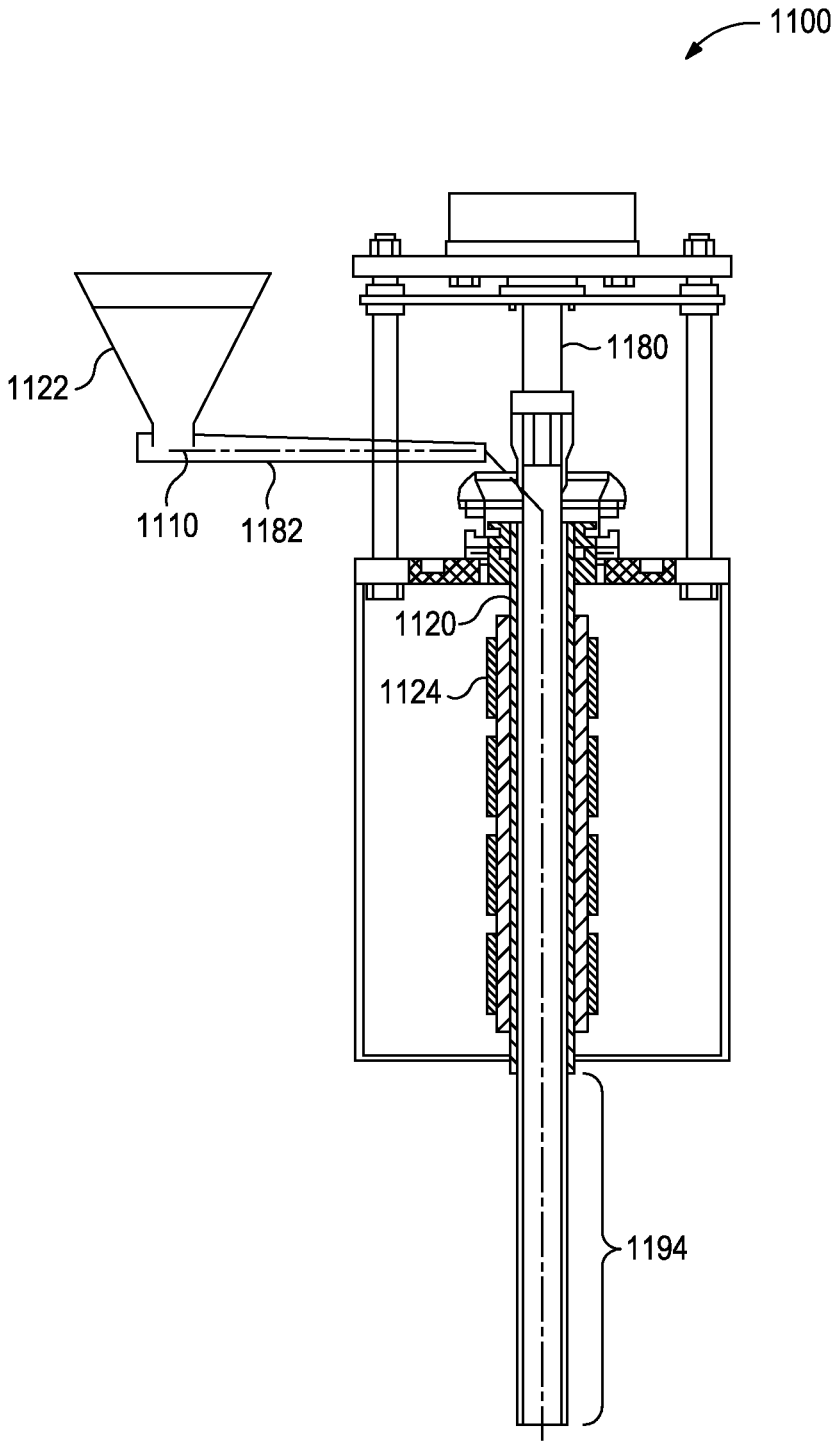
FIG. 11 illustrates a nonlimiting example of a system for forming organic porous masses according to the present invention (not necessarily to scale).

Referring now to FIG. 11, hopper 1122 is operably attached to chute 1182 and feeds the matrix material to material path 1110. Along material path 1110, mold cavity 1120 is configured to accept ram 1180, which is capable of pressing the matrix material in mold cavity 1120. Heating element 1124, in thermal communication with the matrix material while in mold cavity 1120, causes the matrix material to mechanically bond at a plurality of points, thereby yielding an organic porous mass length. Inclusion of ram 1180 in system 1100 may advantageously assist in ensuring the matrix material is properly packed so as to form an organic porous mass length with a desired void volume. Further, system 1100 comprises cooling area 1194, while the organic porous mass length is still contained within mold cavity 1120. In this nonlimiting example, cooling is achieved passively.

Figure 12:
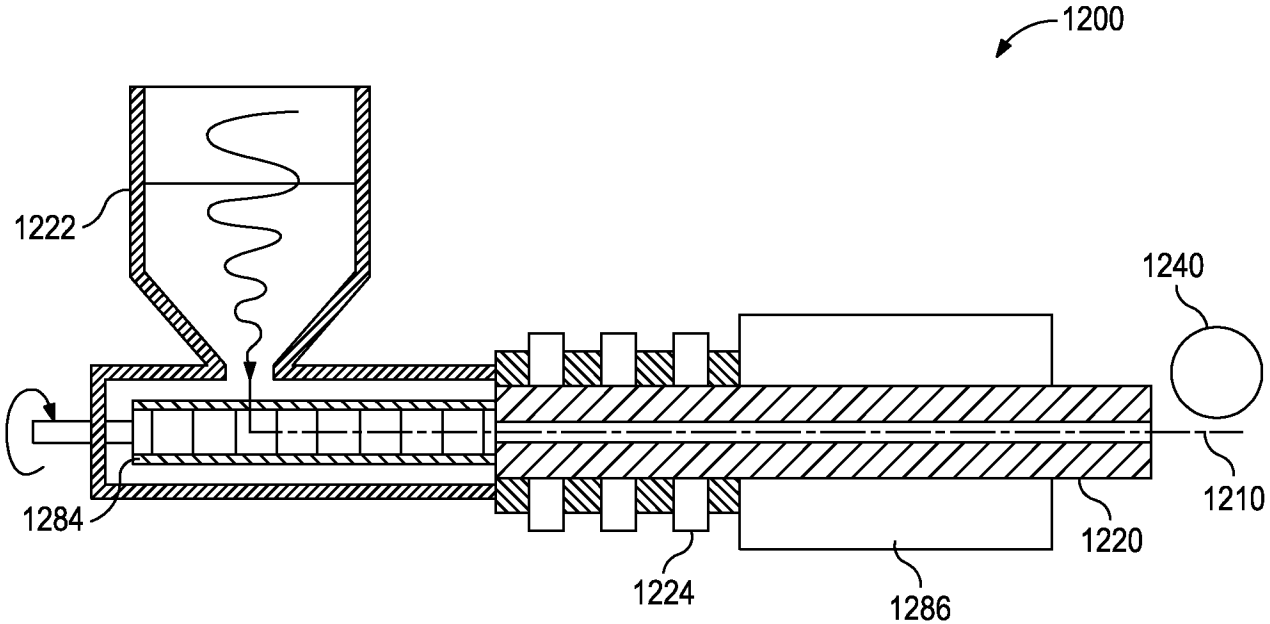
FIG. 12 illustrates a nonlimiting example of a system for forming organic porous masses according to the present invention (not necessarily to scale).

Referring now to FIG. 12, hopper 1222 of system 1200 operably feeds the matrix material to extruder 1284 (e.g., screw) along material path 1210. Extruder 1284 moves matrix material to mold cavity 1220. System 1200 also includes heating element 1224 in thermal communication with the matrix material while in mold cavity 1220 that causes the matrix material to mechanically bond at a plurality of points, thereby yielding an organic porous mass length. Further, system 1200 includes cooling element 1286 in thermal communication with organic porous mass length while in mold cavity 1220. Movement of the organic porous mass length out of mold cavity 1220 is assisted and/or directed by roller 1240.

In some embodiments, a control system may interface with components of the systems and/or apparatuses disclosed herein. As used herein, the term "control system" refers to a system that can operate to receive and send electronic or pneumatic signals and may include functions of interfacing with a user, providing data readouts, collecting data, storing data, changing variable setpoints, maintaining setpoints, providing notifications of failures, and any combination thereof. Suitable control systems may include, but are not limited to, variable transformers, ohmmeters, programmable logic controllers, digital logic circuits, electrical relays, computers, virtual reality systems, distributed control systems, and any combination thereof. Suitable system and/or apparatus components that may be operably connected to a control system may include, but not be limited to, hoppers, heating elements, cooling elements, cutters, mixers, paper feeders, release feeders, release conveyors, cleaning elements, rollers, mold cavity conveyors, conveyors, ejectors, liquid jets, air jets, rams, chutes, extruders, injectors, matrix material feeders, glue feeders, grinders, and the like, and any combination thereof. It should be noted that systems and/or apparatuses disclosed herein may have more than one control system that can interface with any number of components.

One skilled in the art, with the benefit of this disclosure, should understand the interchangeability of the various components of the systems and/or apparatuses disclosed herein. By way of nonlimiting example, heating elements may be interchanged with electromagnetic radiation sources (e.g., a microwave source) when the matrix material comprises a component capable of converting electromagnetic radiation to heat (e.g., nanoparticles, carbon particles, and the like). Further, by way of nonlimiting example, paper wrappers may be interchanged with release wrappers.

In some embodiments, organic porous masses may be produced at linear speeds of about 800 m/min or less, including by methods that involve very slow linear speeds of less than about 1 m/min. As used herein, the term "linear speed" refers to the speed along a single production line in contrast to a production speed that may encompass several production lines in parallel, which may be along individual apparatuses, within a single apparatus, or a combination thereof. In some embodiments, organic porous masses may be produced by methods described herein at linear speeds that range from a lower limit of about 1 m/min, 10 m/min, 50 m/min, or 100 m/min to an upper limit of about 800 m/min, 600 m/min, 500 m/min, 300 m/min, or 100 m/min, and wherein the linear speed may range from any lower limit to any upper limit and encompass any subset therebetween. One skilled in the art would recognized that productivity advancements in machinery may enable linear speeds of greater than 800 m/min (e.g., 1000 m/min or greater). One of ordinary skill in the art should also understand that a single apparatus may include multiple lines (e.g., two or more lines of FIG. 7 or other lines illustrated herein) in parallel so as to increase the overall production rate of organic porous masses and the like, e.g., to several thousand m/min or greater.

Some embodiments may involve further processing of organic porous masses. Suitable further processing may include, but not be limited to, doping with an additive, grinding, drilling out, further shaping, forming multi-segmented filters, forming smoking devices, packaging, shipping, and any combination thereof.

Some embodiments may involve doping matrix materials and/or organic porous masses with an additive. Nonlimiting examples of additives are provided below. Suitable doping methods may include, but not be limited to, including the additives in the matrix material; by applying the additives to at least a portion of the matrix material before mechanical bonding; by applying the additives after mechanical bonding while in the mold cavity; by applying the additives after leaving the mold cavity; by applying the additives after cutting; and any combination thereof. It should be noted that applying includes, but is not limited to, dipping, immersing, submerging, soaking, rinsing, washing, painting, coating, showering, drizzling, spraying, placing, dusting, sprinkling, affixing, and any combination thereof. Further, it should be noted that applying includes, but is not limited to, surface treatments, infusion treatments where the additive incorporates at least partially into a component of the matrix material, and any combination thereof. One skilled in the art with the benefit of this disclosure should understand the concentration of the additive will depend at least on the composition of the additive, the size of the additive, the purpose of the additive, and the point in the process in which the additive is included.

In some embodiments, doping with an additive may occur before, during, and/or after mechanically bonding the matrix materials. One skilled in the art with the benefit of this disclosure should understand that additives which degrade, change, or are otherwise affected by the mechanical bonding process and associated parameter (e.g., elevated temperatures and/or pressures) should be added after mechanical bonding and/or the parameters should be adjusted accordingly (e.g., use of inert gases or reduced temperatures). By way of nonlimiting example, glass beads may be an additive in the matrix material. Then, after mechanical bonding, the glass beads may be functionalized with other additives.

Some embodiments may involve grinding organic porous masses after being produced. Grinding includes those methods and apparatuses/components described above.

Figure 13:
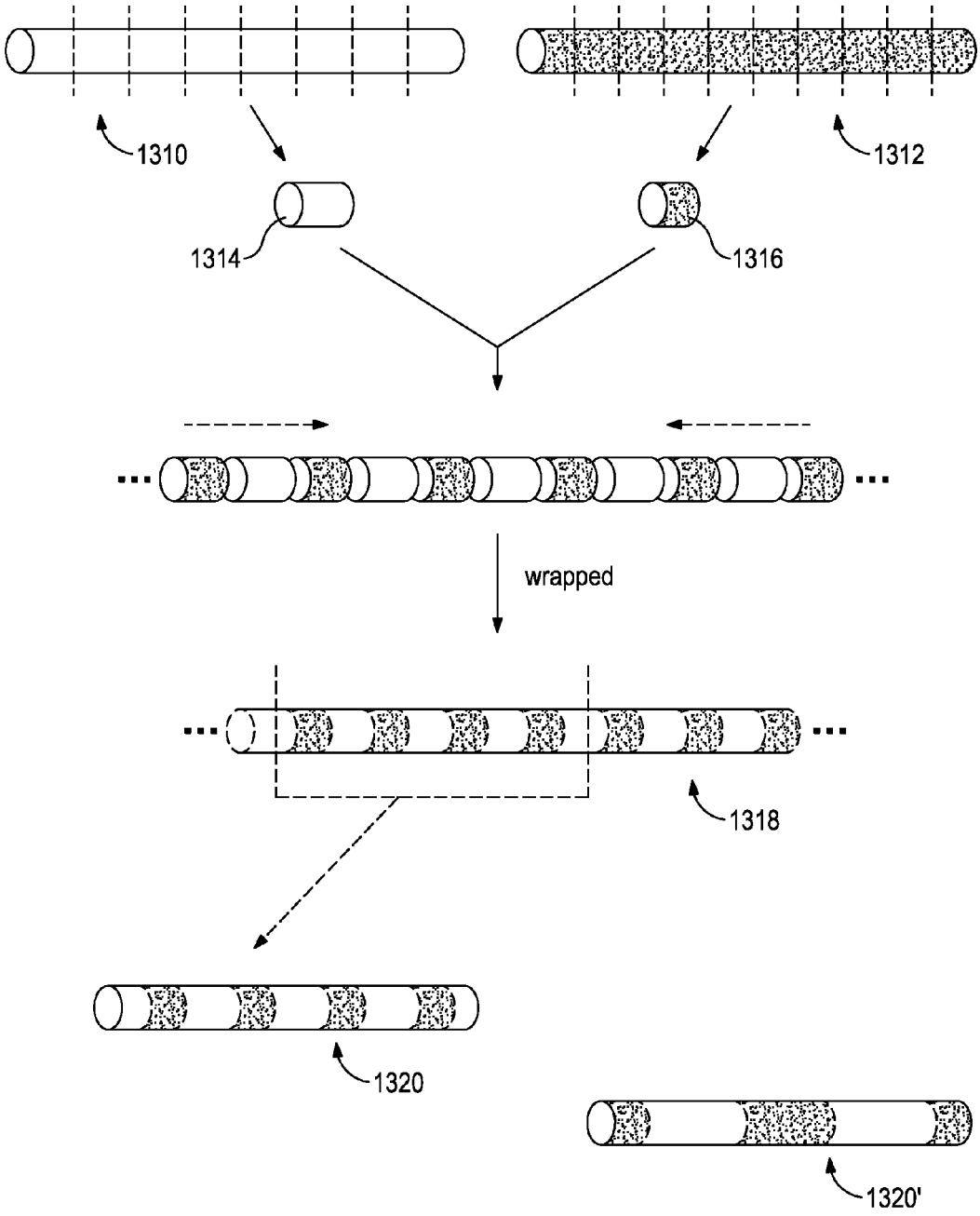
FIG. 13 shows an illustrative diagram of the process of producing the filter rods according to at least some embodiments of the present invention.

II. Methods of Forming Filters and Smoking Devices Comprising Organic Porous Masses Some embodiments may involve operably connecting organic porous masses (including sections thereof) to filters and/or filter sections, e.g., as illustrated in FIG. 13 described in more detail herein. Suitable filters and/or filter sections may comprise at least one of cellulose, cellulosic derivatives, cellulose ester tow, cellulose acetate tow, cellulose acetate tow with less than about 10 denier per filament, cellulose acetate tow with about 10 denier per filament or greater, random oriented acetates, papers, corrugated papers, polypropylene, polyethylene, polyolefin tow, polypropylene tow, polyethylene terephthalate, polybutylene terephthalate, coarse powders, carbon particles, carbon fibers, fibers, glass beads, zeolites, molecular sieves, a second organic porous mass, a porous mass, and any combination thereof. Nonlimiting examples of porous masses are described in detail in co-pending applications PCT/US2011/043264, PCT/US2011/043268, PCT/US2011/043269, and PCT/US2011/043271 all filed on Jul. 7, 2012, the entire disclosures of which are included herein by reference. Further, porous masses are describe in more detail herein.

In some embodiments, organic porous masses and other filter sections may independently have features like a concentric filter design, a paper wrapping, a cavity, a void chamber, a baffled void chamber, capsules, channels, and the like, and any combination thereof.

In some embodiments, organic porous masses and other filter sections may have substantially the same cross-sectional shape and/or circumference.

In some embodiments, a filter section may comprise a space that defines a cavity between two filter sections. The cavity may, in some embodiments, be filled with an additive, e.g., granulated carbon or flavorant (e.g., organic particles, essential oils, and the like). The cavity may, in some embodiments, contain a capsule, e.g., a polymeric capsule, that itself contains a catalyst. The cavity, in some embodiments, may also contain a molecular sieve that reacts with selected components in the smoke to remove or reduce the concentration of the components without adversely affecting desirable flavor constituents of the smoke. In an embodiment, the cavity may include tobacco as an additional flavorant. One should note that if the cavity is insufficiently filled with a chosen substance, in some embodiments, this may create a lack of interaction between the components of the mainstream smoke and the substance in the cavity and in the other filter section(s).

In some embodiments, filter sections may be combined or joined so as to form a filter or a filter rod. As used herein the term "filter rod" refers to a length of filter that is suitable for being cut into two or more filters. By way of nonlimiting example, the filter rods that comprise an organic porous mass described herein may, in some embodiments, have lengths ranging from about 80 mm to about 150 mm and may be cut into filters having lengths about 5 to about 35 mm in length during a smoking device tipping operation (the addition of a tobacco column to a filter).

Tipping operations may involve combining or joining a filter or filter rod described herein with a tobacco column. During tipping operations, the filter rods that comprise an organic porous mass described herein may, in some embodiments, be first cut into filters or cut into filters during the tipping process. Further, in some embodiments, tipping methods may further involve combining or joining additional sections that comprise paper and/or charcoal to the filter, filter rods, or tobacco column.

In the production of filters, filter rods, and/or smoking devices, some embodiments may involve wrapping a paper about the various components thereof so as to maintain the components in the desired configuration and/or contact. For example, producing filter and/or filter rods may involve wrapping paper about a series of abutting filter sections. In some embodiments, organic porous masses wrapped with a paper wrapping may have an additional wrapping disposed thereabout to maintain contact between the organic porous mass and another section of the filter. Suitable papers for producing filters, filter rods, and/or smoking devices may include any paper described herein in relation to wrapping organic porous masses. In some embodiments, the papers may comprise additives, sizing, and/or printing agents.

In the production of filters, filter rods, and/or smoking devices, some embodiments may involve adhering adjacent components thereof (e.g., an organic porous mass to an adjacent filter section, tobacco column, and the like, or any combination thereof). Preferable adhesives may include those that do not impart flavor or aroma under ambient conditions and/or under burning conditions. In some embodiments, wrapping and adhering may be utilized in the production of filters, filter rods, and/or smoking devices.

Some embodiments of the present invention may involve providing an organic porous mass rod that comprise a plurality of organic particles and binder particles bound together at a plurality of contact points; providing a filter rod that does not have the same composition as the organic porous mass rod; cutting the organic porous mass rod and the filter rod into organic porous mass sections and filter sections, respectively; forming a desired abutting configuration that comprises a plurality of sections, the plurality of sections comprising at least some of the organic porous mass sections and at least some of the filter sections; securing the desired abutting configuration with a paper wrapper and/or an adhesive so as to yield a segmented filter rod length; cutting the segmented filter rod length into segmented filter rods; and wherein the method is performed so as to produce the segmented filter rods at a rate of about 800 m/min or less. Some embodiments may further involve forming a smoking device with at least a portion of the segmented filter rod.

As used herein, the term "abutting configuration" refers to a configuration where two filter sections (or the like) are axially aligned so as to touch one end of the first section to one end of the second section. One skilled in the art would understand that this abutting configuration can be continuous (i.e., not never-ending, rather very long) with a large number of sections or short in length with at least two to many sections.

It should be noted that in some method embodiments described herein, the term "segmented" is used for clarity to modify various articles and should be viewed to be encompassed by various embodiments described herein with reference to articles (e.g., filters and filter rods) comprising organic porous masses.

In some embodiments, filters may comprise at least two sections, wherein at least one section is an organic porous mass described herein and at least one section is an other filter section. In some embodiments, other filter sections may comprise at least one of cellulose, cellulosic derivatives, cellulose ester tow, cellulose acetate tow, cellulose acetate tow with less than about 10 denier per filament, cellulose acetate tow with about 10 denier per filament or greater, random oriented acetates, papers, corrugated papers, polypropylene, polyethylene, polyolefin tow, polypropylene tow, polyethylene terephthalate, polybutylene terephthalate, coarse powders, carbon particles, carbon fibers, fibers, glass beads, zeolites, molecular sieves, porous masses, and any combination thereof. Nonlimiting examples of porous masses are described in detail in co-pending applications PCT/US2011/043264, PCT/US2011/043268, PCT/US2011/043269, and PCT/US2011/043271 all filed on Jul. 7, 2012, the entire disclosures of which are included herein by reference. Further, porous masses are describe in more detail herein.

In some embodiments, filters described herein may have an EPD in ranging from a lower limit of about 0.10 mm of water per mm of length, 1 mm of water per mm of length, 2 mm of water per mm of length, 3 mm of water per mm of length, 4 mm of water per mm of length, 5 mm of water per mm of length, 6 mm of water per mm of length, 7 mm of water per mm of length, 8 mm of water per mm of length, 9 mm of water per mm of length, or 10 mm of water per mm of length to an upper limit of about 20 mm of water per mm of length, 19 mm of water per mm of length, 18 mm of water per mm of length, 17 mm of water per mm of length, 16 mm of water per mm of length, 15 mm of water per mm of length, 14 mm of water per mm of length, 13 mm of water per mm of length, 12 mm of water per mm of length, 11 mm of water per mm of length, 10 mm of water per mm of length, 9 mm of water per mm of length, 8 mm of water per mm of length, 7 mm of water per mm of length, 6 mm of water per mm of length, or 5 mm of water per mm of length, wherein the EPD may range from any lower limit to any upper limit and encompass any subset therebetween.

In some embodiments, the filter may have a structure with a first other filter segment proximal to the mouth end of the smoking device. In some embodiments, the filter may comprise two or more sections in any desired order, e.g., in order a first other filter section (e.g., cellulose acetate tow), an organic porous mass, and a second other filter section (e.g., cellulose acetate tow) or in order a first other filter section (e.g., cellulose acetate tow), a first organic porous mass (e.g., comprising tobacco-derived organic particles), a second organic porous mass (e.g., comprising cinnamon organic particles), a second other filter section (e.g., a porous mass), and a third other filter section (e.g., cellulose acetate tow). The use of two or more organic porous masses may advantageously allow for the production of organic porous masses with single or a few mixed organic particles and then design of filters with more complex flavor profiles. Further, different organic particles may have different production limitations (e.g., temperature limits), such that organic porous mass production may need to be optimized for different organic particles.

Within a structure, the length and composition of individual sections may be chosen to achieve a desired EPD and smoke stream component reduction. One skilled in the art with the benefit of this disclosure should understand the multitude of structures for the filter described herein. In some instances, filters may preferably have cellulose acetate (or other traditional filter material) segments at both ends, i.e., the mouth end and the tobacco end. In some embodiments, other filter segments comprising additives designed for enhanced reduction in smoke stream components may be upstream of the organic porous masses (i.e., proximal to the tobacco relative to the organic porous masses).

Some embodiments of the present invention may involve providing a plurality of organic porous mass sections that comprise a plurality of organic particles and binder particles bound together at a plurality of contact points; providing a plurality of filter sections that do not have the same composition as the organic porous mass sections; forming a desired abutting configuration that comprises a plurality of sections, the plurality of sections comprising at least one of the organic porous mass sections and at least one of the filter sections; securing the desired abutting configuration with a paper wrapper and/or adhesive so as to produce a segmented filter or a segmented filter rod length; and wherein the method is performed so as to produce the segmented filter or the segmented filter rod at a rate of about 800 m/min or less. Some embodiments may further involve forming a smoking device with the segmented filter or at least a portion of the segmented filter rod.

Referring now to FIG. 13, a diagram of the process of producing the segmented filters in this example, cellulose acetate filter rods 1310, 1312 were cut into 8 sections (about 15 mm each) to yield cellulose acetate segments 1314 and porous mass rods 1312 into 10 segments (about 12 mm each) to yield porous mass segments 1316. The segments 1314, 1316 were then aligned end-on-end in an alternating configuration, pushed together, and wrapped with paper that was glued at the same line so as to yield a segmented filter length 1318. The segmented filter length 1318 was then cut in about the middle of every fourth cellulose acetate segment 1314 so as to yield segmented filter rod 1320 having portions of a cellulose acetate segment 1314 disposed on each end. One skilled in the art with the benefit of this disclosure will understand that other sizes and configurations of cellulose acetate segments and porous mass segments may be used to yield the segmented filter lengths and can then be cut at any point to yield a desired segmented filter rod, e.g., segmented filter rod 1320'.

Figure 14:
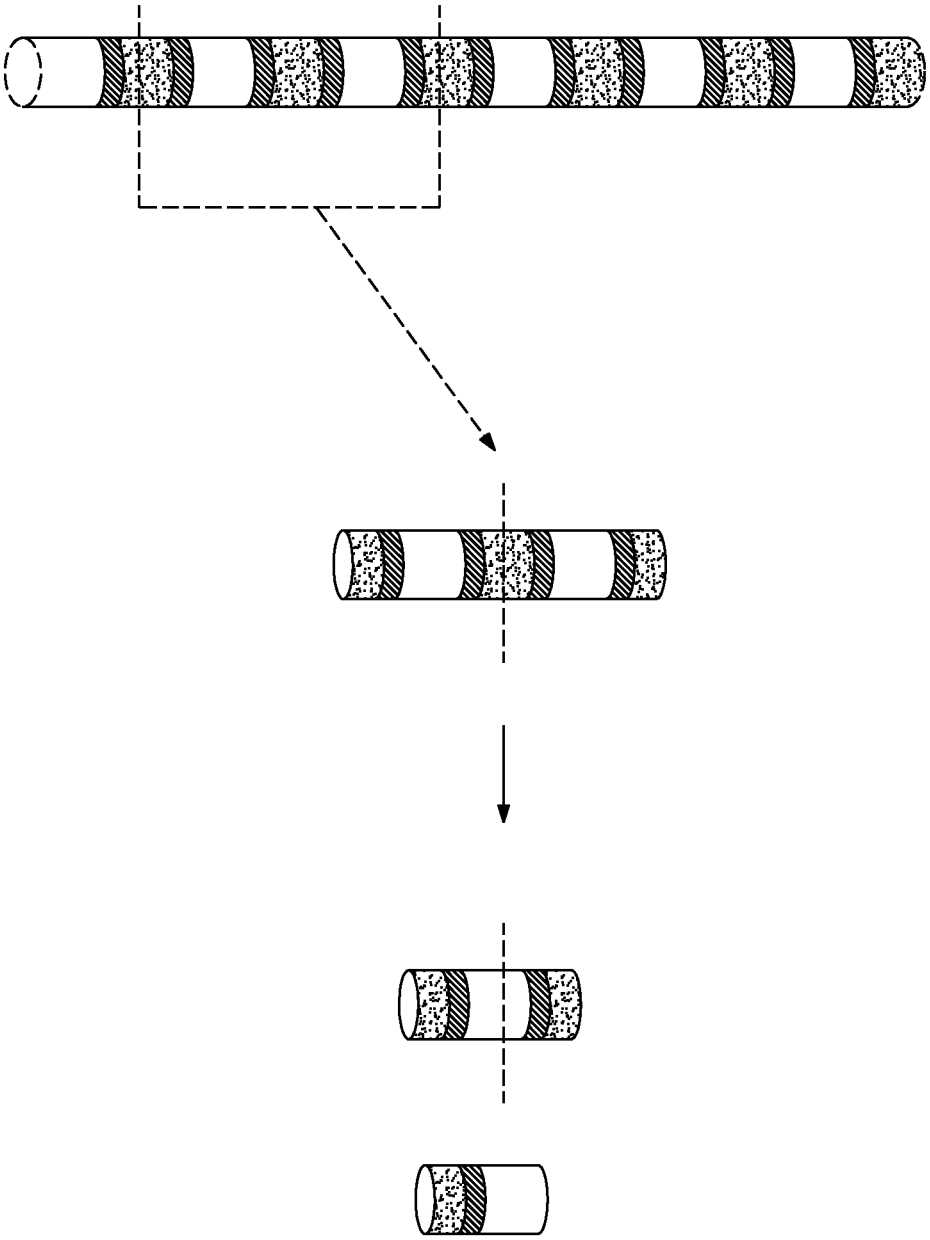
FIG. 14 shows an illustrative diagram relating to at least some methods of the present invention for forming filters according to at least some embodiments described herein.

In some embodiments, the foregoing method may be adapted to accommodate three or more filter sections. For example, a desired configuration of a filter rod length including first filter sections, organic porous mass sections, and second filter sections in series such that the rod includes a first first filter section, a first organic porous mass section, a first second filter section, a second organic porous mass section, a second first filter section, a third organic porous mass section, a second second filter section, and so on. Such a configuration may be at least one embodiment useful for producing filters that comprise three sections, as illustrated in FIG. 14, which illustrates a filter rod length being cut into a filter rod that is then cut two additional times so as to yield a filter section comprising three sections.

In some embodiments, a capsule may be included so as to be nested between two abutting sections. As used herein, the term "nested" or "nesting" refers to being inside and not directly exposed to the exterior of the article produced. Accordingly, nesting between two abutting sections allows for the adjacent sections to be touching, i.e., abutting. In some embodiments, a capsule may be in a portion of a filter section or organic porous mass section.

In some embodiments, filters described herein may be produced using known instrumentation, e.g., greater than about 25 m/min in automated instruments and lower for hand production instruments. While the rate of production may be limited by the instrument capabilities only, in some embodiments, filter sections described herein may be combined to form a filter rod at a rate ranging from a lower limit of about 25 m/min, 50 m/min, or 100 m/min to an upper limit of about 800 m/min, 600 m/min, 400 m/min, 300 m/min, or 250 m/min, and wherein the rate may range from any lower limit to any upper limit and encompasses any subset therebetween.

In some embodiments, organic porous masses utilized in the production of filter and/or filter rods described herein may be wrapped with a paper. The paper may, in some embodiments, reduce damage and particulate production due to the mechanical manipulation of the organic porous masses. Paper suitable for use in conjunction with protecting organic porous masses during manipulation may include, but are not limited to, wood-based papers, papers containing flax, flax papers, cotton paper, functionalized papers (e.g., those that are functionalized so as to reduce tar and/or carbon monoxide), special marking papers, colorized papers, and any combination thereof. In some embodiments, the papers may be high porosity, corrugated, and/or have a high surface strength. In some embodiments, papers may be substantially non-porous less, e.g., than about 10 CORESTA units.

In some embodiments, the filters and/or filter rods comprising organic porous masses described herein may be directly transported to a manufacturing line whereby they will be combined with tobacco columns to form smoking devices. An example of such a method includes a process for producing a smoking device comprising: providing a filter rod comprising at least one filter section comprising an organic porous mass described herein that comprises an organic particle and a binder particle; providing a tobacco column; cutting the filter rod transverse to its longitudinal axis through the center of the rod to form at least two filters having at least one filter section, each filter section comprising an organic porous mass that comprises an organic particle and a binder particle; and joining at least one of the filters to the tobacco column along the longitudinal axis of the filter and the longitudinal axis of the tobacco column to form at least one smoking device.

In other embodiments, the device filters and/or filter rods comprising organic porous masses may be placed in a suitable container for storage until further use. Suitable storage containers include those commonly used in the smoking device filter art including, but not limited to, crates, boxes, drums, bags, cartons, and the like.

Some embodiments may involve operably connecting smokeable substances to organic porous masses (or segmented filters comprising at least one of the foregoing). In some embodiments, organic porous masses (or segmented filters comprising at least one of the foregoing) may be in fluid communication with a smokeable substance. In some embodiments, a smoking device may comprise organic porous masses (or segmented filters comprising at least one of the foregoing) in fluid communication with a smokeable substance. In some embodiments, a smoking device may comprise a housing operably capable of maintaining organic porous masses (or segmented filters comprising at least one of the foregoing) in fluid communication with a smokeable substance. In some embodiments, filter rods, filters, filter sections, sectioned filters, and/or sectioned filter rods may be removable, replaceable, and/or disposable from the housing.

As used herein, the term "smokeable substance" refers to a material capable of producing smoke when burned or heated. Suitable smokeable substances may include, but not be limited to, tobaccos, e.g., bright leaf tobacco, Oriental tobacco, Turkish tobacco, Cavendish tobacco, corojo tobacco, criollo tobacco, Perique tobacco, shade tobacco, white burley tobacco, flue-cured tobacco, Burley tobacco, Maryland tobacco, Virginia tobacco; teas; herbs; carbonized or pyrolyzed components; inorganic filler components; and any combination thereof. Tobacco may have the form of tobacco lamina in cut filler form, processed tobacco stems, reconstituted tobacco filler, volume expanded tobacco filler, or the like. Tobacco, and other grown smokeable substances, may be grown in the United States, or may be grown in a jurisdiction outside the United States.

In some embodiments, a smokeable substance may be in a column format, e.g., a tobacco column. As used herein, the term "tobacco column" refers to the blend of tobacco, and optionally other ingredients and flavorants that may be combined to produce a tobacco-based smokeable article, such as a cigarette or cigar. In some embodiments, the tobacco column may comprise ingredients selected from the group consisting of: tobacco, sugar (such as sucrose, brown sugar, invert sugar, or high fructose corn syrup), propylene glycol, glycerol, cocoa, cocoa products, carob bean gums, carob bean extracts, and any combination thereof. In still other embodiments, the tobacco column may further comprise flavorants, aromas, menthol, licorice extract, diammonium phosphate, ammonium hydroxide, and any combination thereof. In some embodiments, tobacco columns may comprise additives. In some embodiments, tobacco columns may comprise at least one bendable element.

Suitable housings may include, but not be limited to, cigarettes, cigarette holders, cigars, cigar holders, pipes, water pipes, hookahs, electronic smoking devices, roll-your-own cigarettes, roll-your-own cigars, papers, and any combination thereof.

Packaging organic porous masses may include, but not be limited to, placing in trays or boxes or protective containers, e.g., trays typically used for packaging and transporting cigarette filter rods.

In some embodiments, the present invention provides a pack of filters and/or smoking devices with filters that comprise organic porous masses. The pack may be a hinge-lid pack, a slide-and-shell pack, a hard-cup pack, a soft-cup pack, a plastic bag, or any other suitable pack container. In some embodiments, the packs may have an outer wrapping, such as a polypropylene wrapper, and optionally a tear tab. In some embodiments, the filters and/or smoking devices may be sealed as a bundle inside a pack. A bundle may contain a number of filters and/or smoking devices, for example, 20 or more. However, a bundle may include a single filter and/or smoking device, in some embodiments, such as exclusive filter and/or smoking device embodiments like those for individual sale, or a filter and/or smoking device comprising a specific spice, like vanilla, clove, or cinnamon.

In some embodiments, the present invention provides a carton of smoking device packs that includes at least one pack of smoking devices that includes at least one smoking device with a filter (multi-segmented or otherwise) that comprises organic porous masses. In some embodiments, the carton (e.g., a container) has the physical integrity to contain the weight from the packs of smoking devices. This may be accomplished through thicker cardstock being used to form the carton or stronger adhesives being used to bind elements of the carton.

Some embodiments may involve shipping organic porous masses. Said organic porous masses may be as individuals, as at least a portion of filters, as at least a portion of smoking devices, in packs, in carton, in trays, and any combination thereof. Shipping may be by train, truck, airplane, boat/ship, and any combination thereof.

Because it is expected that a consumer will smoke a smoking device that includes an organic porous mass as described herein, the present invention also provides methods of smoking such a smoking device. For example, in one embodiment, the present invention provides a method of smoking a smoking device comprising: heating or lighting a smoking device to form smoke, the smoking device comprising a filter according to any of the embodiments described herein (e.g., comprising organic porous masses with organic particles described herein, binder particles described herein, optionally additives described herein, optionally with features described herein, and the like; comprising filter sections with materials described herein, optionally dopants described herein, optionally additives described herein, optionally with features described herein, and the like; having an EPD described herein; having a structure described herein; and the like).

III. Organic Porous Masses

In some embodiments, organic particles for use in organic porous masses may be produced by grinding natural compositions. Examples of natural compositions of organic particles may include, but are not limited to, cloves, tobacco, coffee beans, cocoa, cinnamon, vanilla, tea, green tea, black tea, bay leaves, citrus peels (e.g., orange, lemon, lime, grapefruit, and the like), cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and the like, and any combination thereof.

In some embodiments, the increased temperature of the smoke stream may enhance the release of flavorant from the organic particles.

In some embodiments, the organic particles may have an average diameter in at least one dimension ranging from a lower limit of about 100 microns, 150 microns, 200 microns, or 250 microns to an upper limit of about 1500 microns, 1000 microns, 750 microns, 500 microns, 400 microns, 300 microns, or 250 microns, wherein the average diameter may range from any lower limit to any upper limit and encompass any subset therebetween. In some embodiments, the organic particles may be a mixture of particle sizes.

Examples of binder particles may include, but are not limited to, polyolefins, polyesters, polyamides (or nylons), polyacrylics, polystyrenes, polyvinyls, polytetrafluoroethylene (PTFE), polyether ether ketone (PEEK), non-fibrous plasticized cellulose, any copolymer thereof, any derivative thereof, and any combination thereof. Examples of suitable polyolefins include, but are not limited to, polyethylene, polypropylene, polybutylene, polymethylpentene, any copolymer thereof, any derivative thereof, any combination thereof and the like. Examples of suitable polyethylenes further include low-density polyethylene, linear low-density polyethylene, high-density polyethylene, any copolymer thereof, any derivative thereof, any combination thereof and the like. Examples of suitable polyesters include polyethylene terephthalate, polybutylene terephthalate, polycyclohexylene dimethylene terephthalate, polytrimethylene terephthalate, any copolymer thereof, any derivative thereof, any combination thereof and the like. Examples of suitable polyacrylics include, but are not limited to, polymethyl methacrylate, any copolymer thereof, any derivative thereof, any combination thereof and the like. Examples of suitable polystyrenes include, but are not limited to, polystyrene, acrylonitrile-butadiene-styrene, styrene-acrylonitrile, styrene-butadiene, styrene-maleic anhydride, any copolymer thereof, any derivative thereof, any combination thereof and the like. Examples of suitable polyvinyls include, but are not limited to, ethylene vinyl acetate, ethylene vinyl alcohol, polyvinyl chloride, any copolymer thereof, any derivative thereof, any combination thereof and the like. Examples of suitable cellulosics include, but are not limited to, cellulose acetate, cellulose acetate butyrate, plasticized cellulosics, cellulose propionate, ethyl cellulose, any copolymer thereof, any derivative thereof, any combination thereof and the like. In some embodiments, a binder particle may be any copolymer, any derivative, and any combination of the above listed binders.

In some embodiments, the binder particles described herein may have a hydrophilic surface treatment. Hydrophilic surface treatments (e.g., oxygenated functionalities like carboxy, hydroxyl, and epoxy) may be achieved by exposure to at least one of chemical oxidizers, flames, ions, plasma, corona discharge, ultraviolet radiation, ozone, and combinations thereof (e.g., ozone and ultraviolet treatments). Because many of the organic particles and active particles described herein are hydrophilic, either as a function of their composition or adsorbed water, a hydrophilic surface treatment to the binder particles may increase the attraction (e.g., van der Waals, electrostatic, hydrogen bonding, and the like) between the binder particles and the organic particles and/or active particles. This enhanced attraction may mitigate segregation of organic particles and/or active particles from binder particles in the matrix material, thereby minimizing variability in the EPD, integrity, circumference, cross-sectional shape, and other properties of the resultant porous masses. Further, it has been observed that the enhanced attraction provides for a more homogeneous matrix material, which can increase flexibility for filter design (e.g., lowering overall EPD, reducing the concentration of the binder particles, or both).

The binder particles may assume any shape. Such shapes include spherical, hyperion, asteroidal, chrondular or interplanetary dust-like, granulated, potato, irregular, and any combination thereof. In preferred embodiments, the binder particles suitable for use in the present invention are non-fibrous. In some embodiments the binder particles are in the form of a powder, pellet, or particulate.

In some embodiments, the binder particles may have an average diameter in at least one dimension ranging from a lower limit of about 0.1 nm, 0.5 nm, 1 nm, 10 nm, 100 nm, 500 nm, 1 micron, 5 microns, 10 microns, 50 microns, 100 microns, 150 microns, 200 microns, or 250 microns to an upper limit of about 5000 microns, 2000 microns, 1000 microns, 900 microns, 700 microns, 500 microns, 400 microns, 300 microns, 250 microns, 200 microns, 150 microns, 100 microns, 50 microns, 10 microns, or 500 nm, wherein the average diameter may range from any lower limit to any upper limit and encompass any subset therebetween. In some embodiments, the binder particles may be a mixture of particle sizes.

In some embodiments, the binder particles may have a bulk density ranging about 0.10 g/cm$^3$ to about 0.55 g/cm$^3$, including any subset therebetween (e.g., about 0.17 g/cm$^3$ to about 0.50 g/cm$^3$ or about 0.20 g/cm$^3$ to about 0.47 g/cm$^3$).

In some embodiments, the binder particles may exhibit virtually no flow at its melting temperature, i.e., when heated to its melting temperature exhibits little to no polymer flow. Materials meeting these criteria may include, but are not limited to, ultrahigh molecular weight polyethylene ("UHMWPE"), very high molecular weight polyethylene ("VHMWPE"), high molecular weight polyethylene ("HMWPE"), and any combination thereof. As used herein, the term "UHMWPE" refers to polyethylene compositions with weight-average molecular weight of at least about $3\times10^6$ g/mol (e.g., about $3\times10^6$ g/mol to about $30\times10^6$ g/mol, including any subset therebetween). As used herein, the term "VHMWPE" refers to polyethylene compositions with a weight average molecular weight of less than about $3\times10^6$ g/mol and more than about $1\times10^6$ g/mol, including any subset therebetween. As used herein, the term "HMWPE" refers to polyethylene compositions with weight-average molecular weight of at least about $3\times10^5$ g/mol to $1\times10^6$ g/mol. For purposes of the present specification, the molecular weights referenced herein are determined in accordance with the Margolies equation ("Margolies molecular weight").

In some embodiments, the binder particles may have a melt flow index ("MFI"), a measure of polymer flow, as measured by ASTM D1238 at 190° C. and 15 kg load ranging from a lower limit of about 0, 0.5, 1.0, or 2.0 g/10 min to an upper limit of about 3.5, 3.0, 2.5, 2.0, 1.5, or 1.0, wherein the MFI may range from any lower limit to any upper limit and encompass any subset therebetween. In some embodiments, organic porous masses may comprise a mixture of binder particles having different molecular weights and/or different melt flow indexes.

In some embodiments, the binder particles may have an intrinsic viscosity ranging from about 5 dl/g to about 30 dl/g (including any subset therebetween) and a degree of crystallinity of about 80% or more (e.g., about 80% to about 100%, including any subset therebetween) as described in U.S. Patent Application Publication No. 2008/0090081.

Examples of commercially available polyethylene materials suitable for use as binder particles described herein may include GUR® (UHMWPE, available from Ticona Polymers LLC, DSM, Braskem, Beijing Factory No. 2, Shanghai Chemical, Qilu, Mitsui, and Asahi) including GUR® 2000 series (2105, 2122, 2122-5, 2126), GUR® 4000 series (4120, 4130, 4150, 4170, 4012, 4122-5, 4022-6, 4050-3/4150-3), GUR® 8000 series (8110, 8020), and GUR® X series (X143, X184, X168, X172, X192). Another example of a suitable polyethylene material is that having a molecular weight in the range of about 300,000 g/mol to about 2,000,000 g/mol as determined by ASTM-D 4020, an average particle size between about 300 microns and about 1500 microns, and a bulk density between about 0.25 g/ml and about 0.5 g/ml.

In some embodiments, the binder particles are a combination of various binder particles as distinguished by composition, shape, size, bulk density, MFI, intrinsic viscosity, and the like, and any combination thereof.

In some embodiments, the matrix material or organic porous masses may comprise organic particles in an amount ranging from a lower limit of about 1 wt %, 5 wt %, 10 wt %, 25 wt %, 40 wt %, 50 wt %, 60 wt %, or 75 wt % of the organic porous mass to an upper limit of about 99 wt %, 95 wt %, 90 wt %, or 75 wt % of the organic porous mass, and wherein the amount of organic particles can range from any lower limit to any upper limit and encompass any subset therebetween. In some embodiments, the matrix material or organic porous masses may comprise binder particles in an amount ranging from a lower limit of about 1 wt %, 5 wt %, 10 wt %, or 25 wt % of the organic porous mass to an upper limit of about 99 wt %, 95 wt %, 90 wt %, 75 wt %, 60 wt %, 50 wt %, 40 wt %, or 25 wt % of the organic porous mass, and wherein the amount of binder particles can range from any lower limit to any upper limit and encompass any subset therebetween.

In some embodiments, organic porous masses described herein may further comprise additives. In some embodiments, the matrix material or organic porous masses may comprise additives in an amount ranging from a lower limit of about 0.01 wt %, 0.05 wt %, 0.1 wt %, 1 wt %, 5 wt %, or 10 wt % of the matrix material or organic porous masses to an upper limit of about 25 wt %, 15 wt %, 10 wt %, 5 wt %, or 1 wt % of the matrix material or organic porous masses, and wherein the amount of additives can range from any lower limit to any upper limit and encompass any subset therebetween.

Suitable additives may include, but not be limited to, active particles, active compounds, ionic resins, zeolites, nanoparticles, microwave enhancement additives, ceramic particles, glass beads, softening agents, plasticizers, pigments, dyes, controlled release vesicles, adhesives, tackifiers, surface modification agents, vitamins, peroxides, biocides, antifungals, antimicrobials, antistatic agents, flame retardants, degradation agents, and any combination thereof, which are described in more detail herein. One of ordinary skill in the art should understand that additives should minimally to not affect the function of the organic particles, e.g., porous additives that adsorb the flavorant from the organic particles.

In some embodiments, organic porous masses described herein may have an EPD in ranging from a lower limit of about 0.10 mm of water per mm of length, 1 mm of water per mm of length, 2 mm of water per mm of length, 3 mm of water per mm of length, 4 mm of water per mm of length, 5 mm of water per mm of length, 6 mm of water per mm of length, 7 mm of water per mm of length, 8 mm of water per mm of length, 9 mm of water per mm of length, or 10 mm of water per mm of length to an upper limit of about 20 mm of water per mm of length, 19 mm of water per mm of length, 18 mm of water per mm of length, 17 mm of water per mm of length, 16 mm of water per mm of length, 15 mm of water per mm of length, 14 mm of water per mm of length, 13 mm of water per mm of length, 12 mm of water per mm of length, 11 mm of water per mm of length, 10 mm of water per mm of length, 9 mm of water per mm of length, 8 mm of water per mm of length, 7 mm of water per mm of length, 6 mm of water per mm of length, or 5 mm of water per mm of length, wherein the EPD may range from any lower limit to any upper limit and encompass any subset therebetween.

In some embodiments, organic porous masses described herein may have an organic particle loading of at least about 1 mg/mm, 2 mg/mm, 3 mg/mm, 4 mg/mm, 5 mg/mm, 6 mg/mm, 7 mg/mm, 8 mg/mm, 9 mg/mm, 10 mg/mm, 11 mg/mm, 12 mg/mm, 13 mg/mm, 14 mg/mm, 15 mg/mm, 16 mg/mm, 17 mg/mm, 18 mg/mm, 19 mg/mm, 20 mg/mm, 21 mg/mm, 22 mg/mm, 23 mg/mm, 24 mg/mm, or 25 mg/mm in combination with an EPD of less than about 20 mm of water or less per mm of length, 19 mm of water or less per mm of length, 18 mm of water or less per mm of length, 17 mm of water or less per mm of length, 16 mm of water or less per mm of length, 15 mm of water or less per mm of length, 14 mm of water or less per mm of length, 13 mm of water or less per mm of length, 12 mm of water or less per mm of length, 11 mm of water or less per mm of length, 10 mm of water or less per mm of length, 9 mm of water or less per mm of length, 8 mm of water or less per mm of length, 7 mm of water or less per mm of length, 6 mm of water or less per mm of length, 5 mm of water or less per mm of length, 4 mm of water or less per mm of length, 3 mm of water or less per mm of length, 2 mm of water or less per mm of length, or 1 mm of water or less per mm of length, and wherein the organic particle loading and the EPD may independently range from any lower limit to any upper limit and encompass any subset therebetween.

In some embodiments, organic porous masses described herein may have a length from a lower limit of about 5 mm, 10 mm, 25 mm, or 50 mm to an upper limit of about 150 mm, 100 mm, 50 mm, or 25 mm, and wherein the links may range from any lower limit to any upper limit and encompass any subset therebetween.

In some embodiments, organic porous masses described herein may further comprise a wrapper disposed about the organic porous masses. Suitable wrappers may include, but not be limited to, papers (e.g., wood-based papers, papers containing flax, flax papers, papers produced from other natural or synthetic fibers, functionalized papers, special marking papers, colorized papers), plastics (e.g., fluorinated polymers like polytetrafluoroethylene, silicone), films, coated papers, coated plastics, coated films, and the like, and any combination thereof. In some embodiments, wrappers may be papers suitable for use in smoking device filters.

In some embodiments, organic porous masses described herein may be any cross-sectional shape including, but not limited to, circular, substantially circular, ovular, substantially ovular, polygonal (like triangular, square, rectangular, pentagonal, and so on), polygonal with rounded edges, and the like, or any hybrid thereof.

The circumference of organic porous masses described herein may range from a lower limit of about 5 mm, 6 mm, 7 mm, 8 mm, 9 mm, 10 mm, 11 mm, 12 mm, 13 mm, 14 mm, 15 mm, 16 mm, 17 mm, 18 mm, 19 mm, 20 mm, 21 mm, 22 mm, 23 mm, 24 mm, 25 mm, or 26 mm to an upper limit of about 60 mm, 50 mm, 40 mm, 30 mm, 20 mm, 29 mm, 28 mm, 27 mm, 26 mm, 25 mm, 24 mm, 23 mm, 22 mm, 21 mm, 20 mm, 19 mm, 18 mm, 17 mm, or 16 mm, wherein the circumference may range from any lower limit to any upper limit and encompass any subset therebetween. In embodiments where an organic porous mass of the present invention is in a shape other than a true cylinder, it should be understood that the term "circumference" is used to mean the perimeter of any shaped cross-section, including a circular cross-section.

In some embodiments, organic porous masses may comprise at least one type of organic particles (e.g., organic particles having a composition described herein, a size described herein, a shape described herein, or a combination thereof) in an amount described herein, at least one type of binder particles (e.g., binder particles having a composition described herein, a size described herein, a shape described herein, a bulk density described herein, an MFI described herein, an intrinsic viscosity described herein, or a combination thereof) in an amount described herein, and optionally at least one type of the additives described herein in an amount described herein. In some embodiments, organic porous masses may have at least one characteristic of: an EPD described herein, a length described herein, a cross-sectional shape described herein, a circumference described herein, a wrapper described herein, or a combination thereof.

IV. Porous Masses

Porous masses generally comprise a plurality of binder particles (e.g., the binder particles described herein relative to organic porous masses) and a plurality of active particles (e.g., carbon particles or zeolites described herein) mechanically bound at a plurality of contact points. The contact points may be active particle-binder contact points, binder-binder contact points, active particle-active particle contact points, and any combination thereof.

In some embodiments, the porous masses may comprise active particles in an amount ranging from a lower limit of about 1 wt %, 5 wt %, 10 wt %, 25 wt %, 40 wt %, 50 wt %, 60 wt %, or 75 wt % of the porous mass to an upper limit of about 99 wt %, 95 wt %, 90 wt %, or 75 wt % of the porous mass, and wherein the amount of active particles can range from any lower limit to any upper limit and encompass any subset therebetween. In some embodiments, the porous masses may comprise binder particles in an amount ranging from a lower limit of about 1 wt %, 5 wt %, 10 wt %, or 25 wt % of the porous mass to an upper limit of about 99 wt %, 95 wt %, 90 wt %, 75 wt %, 60 wt %, 50 wt %, 40 wt %, or 25 wt % of the porous mass, and wherein the amount of binder particles can range from any lower limit to any upper limit and encompass any subset therebetween.

While the ratio of binder particle size to active particle size can include any iteration as dictated by the size ranges for each described herein, specific size ratios may be advantageous for specific applications and/or products. By way of nonlimiting example, in smoking device filters the sizes of the active particles and binder particles should be such that the EPD allows for drawing fluids through the porous mass. In some embodiments, the ratio of binder particle size to active particle size may range from about 10:1 to about 1:10, or more preferably range from about 1:1.5 to about 1:4.

In some embodiments, porous masses may have a void volume in the range of about 40% to about 90%. In some embodiments, porous masses may have a void volume of about 60% to about 90%. In some embodiments, porous masses may have a void volume of about 60% to about 85%. Void volume is the free space left after accounting for the space taken by the active particles.

To determine void volume, although not wishing to be limited by any particular theory, it is believed that testing indicates that the final density of the mixture was driven almost entirely by the active particle; thus the space occupied by the binder particles was not considered for this calculation. Thus, void volume, in this context, is calculated based on the space remaining after accounting for the active particles. To determine void volume, first the upper and lower diameters based on the mesh size were averaged for the active particles, and then the volume was calculated (assuming a spherical shape based on that averaged diameter) using the density of the active material. Then, the percentage void volume is calculated as follows:

$$\text{Void Volume}(\%) = \frac{\left[\text{(porous mass volume, cm}^3\text{)} - \frac{\text{(Weight of active particles, gm)}}{\text{(density of the active particles, gm/cm}^3\text{)}}\right] * 100}{\text{porous mass volume, cm}^3}$$

In some embodiments, porous masses may have an encapsulated pressure drop (EPD) in the range of about 0.10 to about 25 mm of water per mm length of porous mass. In some embodiments, porous masses may have an EPD in the range of about 0.10 to about 10 mm of water per mm length of porous mass. In some embodiments, porous masses may have an EPD of about 2 mm of water per mm length to about 7 mm of water per mm length of porous mass (or no greater than 7 mm of water per mm length of porous mass).

In some embodiments, porous masses may have an active particle loading of at least about 1 mg/mm, 2 mg/mm, 3 mg/mm, 4 mg/mm, 5 mg/mm, 6 mg/mm, 7 mg/mm, 8 mg/mm, 9 mg/mm, 10 mg/mm, 11 mg/mm, 12 mg/mm, 13 mg/mm, 14 mg/mm, 15 mg/mm, 16 mg/mm, 17 mg/mm, 18 mg/mm, 19 mg/mm, 20 mg/mm, 21 mg/mm, 22 mg/mm, 23 mg/mm, 24 mg/mm, or 25 mg/mm in combination with an EPD of less than about 20 mm of water or less per mm of length, 19 mm of water or less per mm of length, 18 mm of water or less per mm of length, 17 mm of water or less per mm of length, 16 mm of water or less per mm of length, 15 mm of water or less per mm of length, 14 mm of water or less per mm of length, 13 mm of water or less per mm of length, 12 mm of water or less per mm of length, 11 mm of water or less per mm of length, 10 mm of water or less per mm of length, 9 mm of water or less per mm of length, 8 mm of water or less per mm of length, 7 mm of water or less per mm of length, 6 mm of water or less per mm of length, 5 mm of water or less per mm of length, 4 mm of water or less per mm of length, 3 mm of water or less per mm of length, 2 mm of water or less per mm of length, or 1 mm of water or less per mm of length, and wherein the active particle loading and the EPD may independently range from any lower limit to any upper limit and encompass any subset therebetween.

By way of example, in some embodiments, porous masses may have an active particle loading of at least about 1 mg/mm and an EPD of about 20 mm of water or less per mm of length. In other embodiments, the porous mass may have an active particle loading of at least about 1 mg/mm and an EPD of about 20 mm of water or less per mm of length, wherein the active particle is not carbon. In other embodiments, the porous mass may have an active particle comprising carbon with a loading of at least 6 mg/mm in combination with an EPD of 10 mm of water or less per mm of length.

In some embodiments, porous masses may further comprise additives. Suitable additives for use in conjunction with porous masses may include, but not be limited to, active compounds, ionic resins, zeolites, nanoparticles, microwave enhancement additives, ceramic particles, glass beads, softening agents, plasticizers, pigments, dyes, flavorants, aromas, controlled release vesicles, adhesives, tackifiers, surface modification agents, vitamins, peroxides, biocides, antifungals, antimicrobials, antistatic agents, flame retardants, degradation agents, and any combination thereof.

V. Additives

One example of an active particle is activated carbon (or activated charcoal or active coal). The activated carbon may be low activity (about 50% to about 75% $CCl_4$ adsorption) or high activity (about 75% to about 95% $CCl_4$ adsorption) or a combination of both. In some embodiments, the active carbon may be nano-scaled carbon particle, such as carbon nanotubes of any number of walls, carbon nanohorns, bamboo-like carbon nanostructures, fullerenes and fullerene aggregates, and graphene including few layer graphene and oxidized graphene. Other examples of active particles may include, but are not limited to, ion exchange resins, desiccants, silicates, molecular sieves, silica gels, activated alumina, zeolites, perlite, sepiolite, Fuller's Earth, magnesium silicate, metal oxides (e.g., iron oxide, iron oxide nanoparticles like about 12 nm $Fe_3O_4$, manganese oxide, copper oxide, and aluminum oxide), gold, platinum, iodine pentoxide, phosphorous pentoxide, nanoparticles (e.g., metal nanoparticles like gold and silver; metal oxide nanoparticles like alumina; magnetic, paramagnetic, and superparamagnetic nanoparticles like gadolinium oxide, various crystal structures of iron oxide like hematite and magnetite, gado-nanotubes, and endofullerenes like $Gd@C_{60}$; and core-shell and onionated nanoparticles like gold and silver nanoshells, onionated iron oxide, and other nanoparticles or microparticles with an outer shell of any of said materials) and any combination of the foregoing (including activated carbon). Ion exchange resins include, for example, a polymer with a backbone, such as styrene-divinyl benzene (DVB) copolymer, acrylates, methacrylates, phenol formaldehyde condensates, and epichlorohydrin amine condensates; and a plurality of electrically charged functional groups attached to the polymer backbone. In some embodiments, the active particles are a combination of various active particles. In some embodiments, the organic porous mass may comprise multiple active particles. In some embodiments, an active particle may comprise at least one element selected from the group of active particles disclosed herein. It should be noted that "element" is being used as a general term to describe items in a list. In some embodiments, the active particles are combined with at least one flavorant.

In some embodiments, the active particles may have an average diameter in at least one dimension ranging from a lower limit of about less than one nanometer (e.g., graphene), about 0.1 nm, 0.5 nm, 1 nm, 10 nm, 100 nm, 500 nm, 1 micron, 5 microns, 10 microns, 50 microns, 100 microns, 150 microns, 200 microns, and 250 microns to an upper limit of about 5000 microns, 2000 microns, 1000 microns, 900 microns, 700 microns, 500 microns, 400 microns, 300 microns, 250 microns, 200 microns, 150 microns, 100 microns, 50 microns, 10 microns, and 500 nm, wherein the average diameter may range from any lower limit to any upper limit and encompass any subset therebetween. In some embodiments, the active particles may be a mixture of particle sizes.

The active particles may, in some embodiments, remove, reduce, or add components to a smoke stream and may in some embodiments be selective. Smoke stream components may include, but not be limited to, acetaldehyde, acetamide, acetone, acrolein, acrylamide, acrylonitrile, aflatoxin B-1,4-aminobiphenyl, 1-aminonaphthalene, 2-aminonaphthalene, ammonia, ammonium salts, anabasine, anatabine, 0-anisidine, arsenic, A-α-C, benz[a]anthracene, benz[b]fluoroanthene, benz[j]aceanthrylene, benz[k]fluoroanthene, benzene, benzo[b]furan, benzo[a]pyrene, benzo[c]phenanthrene, beryllium, 1,3-butadiene, butyraldehyde, cadmium, caffeic acid, carbon monoxide, catechol, chlorinated dioxins/furans, chromium, chrysene, cobalt, coumarin, a cresol, crotonaldehyde, cyclopenta[c,d]pyrene, dibenz(a,h)acridine, dibenz(a,j)acridine, dibenz[a,h]anthracene, dibenzo(c,g)carbazole, dibenzo[a,e]pyrene, dibenzo[a,h]pyrene, dibenzo[a,i]pyrene, dibenzo[a,l]pyrene, 2,6-dimethylaniline, ethyl carbamate (urethane), ethylbenzene, ethylene oxide, eugenol, formaldehyde, furan, glu-P-1, glu-P-2, hydrazine, hydrogen cyanide, hydroquinone, indeno[1,2,3-cd]pyrene, IQ, isoprene, lead, MeA-α-C, mercury, methyl ethyl ketone, 5-methylchrysene, 4-(methylnitrosamino)-1-(3-pyridyl)-1-butanone (NNK), 4-(methylnitrosamino)-1-(3-pyridyl)-1-butanol (NNAL), naphthalene, nickel, nicotine, nitrate, nitric oxide, a nitrogen oxide, nitrite, nitrobenzene, nitromethane, 2-nitropropane, N-nitrosoanabasine (NAB), N-nitrosodiethanolamine (NDELA), N-nitrosodiethylamine, N-nitrosodimethylamine (NDMA), N-nitrosoethylmethylamine, N-nitrosomorpholine (NMOR), N-nitrosonornicotine (NNN), N-nitrosopiperidine (NPIP), N-nitrosopyrrolidine (NPYR), N-nitrososarcosine (NSAR), phenol, PhIP, polonium-210 (radio-isotope), propionaldehyde, propylene oxide, pyridine, quinoline, resorcinol, selenium, styrene, tar, 2-toluidine, toluene, Trp-P-1, Trp-P-2, uranium-235 (radio-isotope), uranium-238 (radio-isotope), vinyl acetate, vinyl chloride, and any combination thereof.

Suitable ionic resins may include, but not be limited to, polymers with a backbone, such as styrene-divinyl benzene (DVB) copolymer, acrylates, methacrylates, phenol formaldehyde condensates, and epichlorohydrin amine condensates; a plurality of electrically charged functional groups attached to the polymer backbone; and any combination thereof.

Zeolites may include crystalline aluminosilicates having pores, e.g., channels, or cavities of uniform, molecular-sized dimensions. Zeolites may include natural and synthetic materials. Suitable zeolites may include, but not be limited to, zeolite BETA ($Na_7(Al_7Si_{57}O_{128})$tetragonal), zeolite ZSM-5 ($Na_n(Al_nSi_{96-n}O_{192})$ $16H_2O$, with n<27), zeolite A, zeolite X, zeolite Y, zeolite K-G, zeolite ZK-5, zeolite ZK-4, mesoporous silicates, SBA-15, MCM-41, MCM48 modified by 3-aminopropylsilyl groups, alumino-phosphates, mesoporous aluminosilicates, other related porous materials (e.g., such as mixed oxide gels), and any combination thereof.

Suitable nanoparticles may include, but not be limited to, nano-scaled carbon particles like carbon nanotubes of any number of walls, carbon nanohorns, bamboo-like carbon nanostructures, fullerenes and fullerene aggregates, and graphene including few layer graphene and oxidized graphene; metal nanoparticles like gold and silver; metal oxide nanoparticles like alumina, silica, and titania; magnetic, paramagnetic, and superparamagnetic nanoparticles like gadolinium oxide, various crystal structures of iron oxide like hematite and magnetite, about 12 nm $Fe_3O_4$, gado-nanotubes, and endofullerenes like $Gd@C_{60}$; and core-shell and onionated nanoparticles like gold and silver nanoshells, onionated iron oxide, and other nanoparticles or microparticles with an outer shell of any of said materials) and any combination of the foregoing (including activated carbon). It should be noted that nanoparticles may include nanorods, nanospheres, nanorices, nanowires, nanostars (like nanotripods and nanotetrapods), hollow nanostructures, hybrid nanostructures that are two or more nanoparticles connected as one, and non-nano particles with nano-coatings or nano-thick walls. It should be further noted that nanoparticles may include the functionalized derivatives of nanoparticles including, but not limited to, nanoparticles that have been functionalized covalently and/or non-covalently, e.g., pi-stacking, physisorption, ionic association, van der Waals association, and the like. Suitable functional groups may include, but not be limited to, moieties comprising amines (1°, 2°, or 3°), amides, carboxylic acids, aldehydes, ketones, ethers, esters, peroxides, silyls, organosilanes, hydrocarbons, aromatic hydrocarbons, and any combination thereof; polymers; chelating agents like ethylenediamine tetraacetate, diethylenetriaminepentaacetic acid, triglycollamic acid, and a structure comprising a pyrrole ring; and any combination thereof. Functional groups may enhance incorporation of nanoparticles into an organic porous mass.

Suitable microwave enhancement additives may include, but not be limited to, microwave responsive polymers, carbon particles, fullerenes, carbon nanotubes, metal nanoparticles, water, and the like, and any combination thereof.

Suitable ceramic particles may include, but not be limited to, oxides (e.g., silica, titania, alumina, beryllia, ceria, and zirconia), nonoxides (e.g., carbides, borides, nitrides, and silicides), composites thereof, and any combination thereof. Ceramic particles may be crystalline, non-crystalline, or semi-crystalline.

As used herein, pigments refer to compounds and/or particles that impart color and are incorporated throughout the matrix material and/or a component thereof. Suitable pigments may include, but not be limited to, titanium dioxide, silicon dioxide, tartrazine, E102, phthalocyanine blue, phthalocyanine green, quinacridones, perylene tetracarboxylic acid di-imides, dioxazines, perinones disazo pigments, anthraquinone pigments, carbon black, titanium dioxide, metal powders, iron oxide, ultramarine, and any combination thereof.

As used herein, dyes refer to compounds and/or particles that impart color and are a surface treatment. Suitable dyes may include, but not be limited to, CARTASOL® dyes (cationic dyes, available from Clariant Services) in liquid and/or granular form (e.g., CARTASOL® Brilliant Yellow K-6G liquid, CARTASOL® Yellow K-4GL liquid, CARTASOL® Yellow K-GL liquid, CARTASOL® Orange K-3GL liquid, CARTASOL® Scarlet K-2GL liquid, CARTASOL® Red K-3BN liquid, CARTASOL® Blue K-5R liquid, CARTASOL® Blue K-RL liquid, CARTASOL® Turquoise K-RL liquid/granules, CARTASOL® Brown K-BL liquid), FASTUSOL® dyes (an auxochrome, available from BASF) (e.g., Yellow 3GL, Fastusol C Blue 74L).

Suitable tackifiers may include, but not be limited to, methylcellulose, ethylcellulose, hydroxyethylcellulose, carboxy methylcellulose, carboxy ethylcellulose, water-soluble cellulose acetate, amides, diamines, polyesters, polycarbonates, silyl-modified polyamide compounds, polycarbamates, urethanes, natural resins, shellacs, acrylic acid polymers, 2-ethylhexylacrylate, acrylic acid ester polymers, acrylic acid derivative polymers, acrylic acid homopolymers, anacrylic acid ester homopolymers, poly(methyl acrylate), poly(butyl acrylate), poly(2-ethylhexyl acrylate), acrylic acid ester co-polymers, methacrylic acid derivative polymers, methacrylic acid homopolymers, methacrylic acid ester homopolymers, poly(methyl methacrylate), poly(butyl methacrylate), poly (2-ethylhexyl methacrylate), acrylamido-methyl-propane sulfonate polymers, acrylamido-methyl-propane sulfonate derivative polymers, acrylamido-methyl-propane sulfonate co-polymers, acrylic acid/acrylamido-methyl-propane sulfonate co-polymers, benzyl coco di-(hydroxyethyl) quaternary amines, p-T-amyl-phenols condensed with formaldehyde, dialkyl amino alkyl(meth)acrylates, acrylamides, N-(dialkyl amino alkyl) acrylamide, methacrylamides, hydroxy alkyl(meth)acrylates, methacrylic acids, acrylic acids, hydroxyethyl acrylates, and the like, any derivative thereof, and any combination thereof.

Suitable vitamins may include, but not be limited to, vitamin A, vitamin B1, vitamin B2, vitamin C, vitamin D, vitamin E, and any combination thereof.

Suitable antimicrobials may include, but not be limited to, anti-microbial metal ions, chlorhexidine, chlorhexidine salt, triclosan, polymoxin, tetracycline, amino glycoside (e.g., gentamicin), rifampicin, bacitracin, erythromycin, neomycin, chloramphenicol, miconazole, quinolone, penicillin, nonoxynol 9, fusidic acid, cephalosporin, mupirocin, metronidazolea secropin, protegrin, bacteriolcin, defensin, nitrofurazone, mafenide, acyclovir, vanocmycin, clindamycin, lincomycin, sulfonamide, norfloxacin, pefloxacin, nalidizic acid, oxalic acid, enoxacin acid, ciprofloxacin, polyhexamethylene biguanide (PHMB), PHMB derivatives (e.g., biodegradable biguanides like polyethylene hexamethylene biguanide (PEHMB)), clilorhexidine gluconate, chlorohexidine hydrochloride, ethylenediaminetetraacetic acid (EDTA), EDTA derivatives (e.g., disodium EDTA or tetrasodium EDTA), the like, and any combination thereof.

Antistatic agents may, in some embodiments, comprise any suitable anionic, cationic, amphoteric or nonionic antistatic agent. Anionic antistatic agents may generally include, but not be limited to, alkali sulfates, alkali phosphates, phosphate esters of alcohols, phosphate esters of ethoxylated alcohols, and any combination thereof. Examples may include, but not be limited to, alkali neutralized phosphate ester (e.g., TRYFAC® 5559 or TRYFRAC® 5576, available from Henkel Corporation, Mauldin, S.C.). Cationic antistatic agents may generally include, but not be limited to, quaternary ammonium salts and imidazolines which possess a positive charge. Examples of nonionics include the poly(oxyalkylene) derivatives, e.g., ethoxylated fatty acids like EMEREST® 2650 (an ethoxylated fatty acid, available from Henkel Corporation, Mauldin, S.C.), ethoxylated fatty alcohols like TRYCOL® 5964 (an ethoxylated lauryl alcohol, available from Henkel Corporation, Mauldin, S.C.), ethoxylated fatty amines like TRYMEEN® 6606 (an ethoxylated tallow amine, available from Henkel Corporation, Mauldin, S.C.), alkanolamides like EMID® 6545 (an oleic diethanolamine, available from Henkel Corporation, Mauldin, S.C.), and any combination thereof. Anionic and cationic materials tend to be more effective antistatic agents.

It should be noted that while organic porous masses discussed herein are primarily for smoking device filters, they may be used as fluid filters (or parts thereof) in other applications including, but not limited to, liquid filtration, air filters in motorized vehicles, air filters in medical devices, air filters for household use, and the like. One skilled in the arts, with the benefit of this disclosure, should understand the necessary modification and/or limitations to adapt this disclosure for other filtration applications, e.g., size, shape, size ratio of organic and binder particles, and composition of the organic porous masses. By way of nonlimiting example, organic porous masses may be formed into other shapes like hollow cylinders for a concentric water filter configuration or pleated sheets for an air filter.

Embodiments disclosed herein include:

A: a method that includes introducing a matrix material into a mold cavity, the matrix material comprising a plurality of binder particles, a plurality of organic particles, and a microwave enhancement additive; heating at least a portion of the matrix material so as to bind the matrix material at a plurality of contact points, thereby forming an organic porous mass length, wherein heating involves irradiating with microwave radiation the at least a portion of the matrix material; and cutting the organic porous mass length radially thereby yielding an organic porous mass;

B: a method that includes introducing a matrix material into a mold cavity, the matrix material comprising a plurality of binder particles, a plurality of organic particles, and a microwave enhancement additive; heating at least a portion of the matrix material in an oxygen-lean atmosphere so as to bind the matrix material at a plurality of contact points, thereby forming an organic porous mass length, wherein heating involves irradiating with microwave radiation the at least a portion of the matrix material; and cutting the organic porous mass length radially thereby yielding an organic porous mass; and C: a method that includes introducing a matrix material into a mold cavity, the matrix material comprising a plurality of binder particles, a plurality of organic particles, and a microwave enhancement additive; heating at least a portion of the matrix material in an increased air pressure atmosphere so as to bind the matrix material at a plurality of contact points, thereby forming an organic porous mass length, wherein heating involves irradiating with microwave radiation the at least a portion of the matrix material; and cutting the organic porous mass length radially thereby yielding an organic porous mass.

Each of embodiments A, B, and C may have one or more of the following additional elements in any combination: Element 1: introducing includes pneumatic dense phase feeding occurring at a feeding rate of about 1 m/min to about 800 m/min; Element 2: introducing includes pneumatic dense phase feeding occurring at a feeding rate of about 1 m/min to about 800 m/min and the mold cavity has a diameter of about 3 mm to about 10 mm; Element 3: preheating the matrix material before introducing; Element 4: heating further involving radiant heating; Element 5: the mold cavity being at least partially formed by a paper wrapper; Element 6: the organic porous mass having an EPD of about 0.1 mm of water per mm of length to about 25 mm of water per mm of length; Element 7: the organic porous mass having an EPD of about 0.1 mm of water per mm of length to about 20 mm of water per mm of length and the porous mass comprising the organic particles at about 1 mg/mm to about 20 mg/mm; Element 8: the natural material comprises at least one selected from the group consisting of cloves, tobacco, coffee beans, cocoa, cinnamon, vanilla, tea, green tea, black tea, bay leaves, citrus peels, orange, lemon, lime, grapefruit, cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and any combination thereof; Element 9: the organic particles having an average diameter of about 100 microns to about 1500 microns; Element 10: the binder particles comprising polyethylene; Element 11: the binder particles comprising UHMWPE; Element 12: the binder particles comprising VHMWPE; Element 13: the binder particles comprising HMWPE; and Element 14: the organic porous mass comprising at least one additive described herein.

By way of non-limiting examples, exemplary combinations independently applicable to A, B, and C include: Element 1 in combination with at least one of Elements 8-14; Element 2 in combination with at least one of Elements 8-14; Element 1 in combination with at least one of Elements 8-14; Element 3 in combination with at least one of Elements 8-14; Elements 1 and 3 optionally in combination with at least one of Elements 8-14; Elements 2 and 3 optionally in combination with at least one of Elements 8-14; Elements 1 and 4 optionally in combination with at least one of Elements 8-14; Elements 2 and 4 optionally in combination with at least one of Elements 8-14; any of the foregoing in combination with Element 5; any of the foregoing in combination with Element 6; any of the foregoing in combination with Element 7; and so on.

Additional embodiments disclosed herein include:

D: a method that includes continuously introducing a matrix material into a mold cavity, the matrix material comprising a plurality of binder particles and a plurality of organic particles; disposing a release wrapper as a liner of the mold cavity; heating at least a portion of the matrix material so as to bind the matrix material at a plurality of contact points thereby forming an organic porous mass length; and cutting the organic porous mass length radially thereby yielding an organic porous mass;

E: a method that includes introducing a matrix material into a plurality of mold cavities, the matrix material comprising a plurality of binder particles and a plurality of organic particles; and heating the matrix material in the mold cavities so as to bind the matrix material at a plurality of contact points thereby forming an organic porous mass; and F: a method that includes continuously combining a matrix material and a paper wrapper to form a desired cross-sectional shape where the matrix material is confined by the paper wrapper, the matrix material comprising a plurality of binder particles and a plurality of organic particles; heating at least a portion of the matrix material so as to bind the matrix material at a plurality of contact points thereby forming an organic porous mass length, wherein heating involves irradiating with microwave radiation the at least a portion of the matrix material; cooling the organic porous mass length; and cutting the organic porous mass length radially thereby producing an organic porous mass.

Each of embodiments D, E, and F may have one or more of the following additional elements in any combination: Element 1: introducing includes pneumatic dense phase feeding occurring at a feeding rate of about 1 m/min to about 800 m/min; Element 2: introducing includes pneumatic dense phase feeding occurring at a feeding rate of about 1 m/min to about 800 m/min and the mold cavity has a diameter of about 3 mm to about 10 mm; Element 3: heating involving irradiating with microwave radiation the at least a portion of the matrix material; Element 4: heating involving radiant heating; Element 5: heating occurring in an oxygen-lean atmosphere; Element 6: heating occurring in an increased air pressure atmosphere; Element 7: the mold cavity being at least partially formed by a paper wrapper; Element 8: the organic porous mass having an EPD of about 0.1 mm of water per mm of length to about 25 mm of water per mm of length; Element 9: the organic porous mass having an EPD of about 0.1 mm of water per mm of length to about 20 mm of water per mm of length and the porous mass comprising the organic particles at about 1 mg/mm to about 20 mg/mm; Element 10: the natural material comprises at least one selected from the group consisting of cloves, tobacco, coffee beans, cocoa, cinnamon, vanilla, tea, green tea, black tea, bay leaves, citrus peels, orange, lemon, lime, grapefruit, cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and any combination thereof; Element 11: the organic particles having an average diameter of about 100 microns to about 1500 microns; Element 12: the binder particles comprising polyethylene; Element 13: the binder particles comprising UHMWPE; Element 14: the binder particles comprising VHMWPE; Element 15: the binder particles comprising HMWPE; and Element 16: the organic porous mass comprising at least one additive described herein.

By way of non-limiting examples, exemplary combinations independently applicable to D, E, and F include: Element 1 in combination with at least one of Elements 8-14; Element 2 in combination with at least one of Elements 10-16; Element 1 in combination with at least one of Elements 10-16; Element 3 in combination with at least one of Elements 10-16; Elements 1 and 3 optionally in combination with at least one of Elements 10-16; Elements 2 and 3 optionally in combination with at least one of Elements 10-16; Elements 1 and 4 optionally in combination with at least one of Elements 10-16; Elements 2 and 4 optionally in combination with at least one of Elements 10-16; any of the foregoing in combination with Element 5; any of the foregoing in combination with Element 6; any of the foregoing in combination with Element 5; any of the foregoing in combination with Element 8; any of the foregoing in combination with Element 9; and so on.

Embodiments disclosed herein include:

G: an organic porous mass including a plurality of binder particles and a plurality of organic particles derived from a natural material, wherein the organic particles and the binder particles are bound together at a plurality of contact points;

H: a filter including an organic porous mass that includes a plurality of organic particles derived from a natural material; and a plurality of binder particles, wherein the organic particles and the binder particles are bound together at a plurality of contact points; and I: a smoking device including a filter with an organic porous mass that includes a plurality of binder particles and a plurality of organic particles derived from a natural material, wherein the organic particles and the binder particles are bound together at a plurality of contact points.

Each of embodiments G, H, and I may have one or more of the following additional elements in any combination: Element 1: the natural material comprises at least one selected from the group consisting of cloves, tobacco, coffee beans, cocoa, cinnamon, vanilla, tea, green tea, black tea, bay leaves, citrus peels, orange, lemon, lime, grapefruit, cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and any combination thereof; Element 2: the organic porous mass has an encapsulated pressure drop of about 0.1 mm of water per mm of length to about 20 mm of water per mm of length; Element 3: the organic particles having an average diameter of about 100 microns to about 1500 microns; Element 4: the binder particles comprising polyethylene; Element 5: the binder particles comprising UHMWPE; Element 6: the binder particles comprising VHMWPE; Element 7: the binder particles comprising HMWPE; Element 8: the organic porous mass comprising at least one additive described herein; Element 9: other filter section (where provided for) comprising at least one selected from the group consisting of cellulose, a cellulosic derivative, a cellulose ester tow, a cellulose acetate tow, a cellulose acetate tow with less than about 10 denier per filament, a cellulose acetate tow with about 10 denier per filament or greater, a random oriented acetate, a paper, a corrugated paper, polypropylene, polyethylene, a polyolefin tow, a polypropylene tow, polyethylene terephthalate, polybutylene terephthalate, a coarse powder, a carbon particle, a carbon fiber, a fiber, a glass bead, a zeolite, a molecular sieve, a porous mass, and any combination thereof; and Element 10: the filter (where provided for) having an encapsulated pressure drop of about 0.1 mm of water per mm of length to about 20 mm of water per mm of length.

By way of non-limiting examples, exemplary combinations independently applicable to G, H, and I include: Element 1 in combination with at least one of Elements 2-8; Element 1 in combination with Elements 2 and 3; Elements 1-3 in combination with at least one of Elements 4-8; and so on. By way of non-limiting example, exemplary combinations independently applicable to B and C include: Element 9 in combination with the foregoing combinations; and Element 10 in combination with the foregoing combinations.

Yet additional embodiments disclosed herein include:

J: a method that includes grinding a natural material into a plurality of organic particles; introducing a matrix material into a mold cavity, the matrix material comprising a plurality of binder particles and the organic particles; heating at least a portion of the matrix material so as to bind the matrix material at a plurality of contact points thereby forming an organic porous mass length; and cutting the organic porous mass length radially thereby yielding an organic porous mass; and K: a method that includes grinding a natural material into a plurality of organic particles; sizing the organic particles; introducing a matrix material into a plurality of mold cavities, the matrix material comprising a plurality of binder particles and the organic particles; and heating the matrix material in the mold cavities so as to bind the matrix material at a plurality of contact points thereby forming an organic porous mass;

L: a method that includes grinding a natural material into a plurality of organic particles; drying the organic particles; introducing a matrix material into a plurality of mold cavities, the matrix material comprising a plurality of binder particles and the organic particles; and heating the matrix material in the mold cavities so as to bind the matrix material at a plurality of contact points thereby forming an organic porous mass; and M: a method that includes grinding a natural material into a plurality of organic particles; drying at least some of the organic particles; sizing the organic particles; introducing a matrix material into a plurality of mold cavities, the matrix material comprising a plurality of binder particles and the organic particles; and heating the matrix material in the mold cavities so as to bind the matrix material at a plurality of contact points thereby forming an organic porous mass.

Each of embodiments J, K, L, and M may have one or more of the following additional elements in any combination: Element 1: introducing includes pneumatic dense phase feeding occurring at a feeding rate of about 1 m/min to about 800 m/min; Element 2: introducing includes pneumatic dense phase feeding occurring at a feeding rate of about 1 m/min to about 800 m/min and the mold cavity has a diameter of about 3 mm to about 10 mm; Element 3: heating involving irradiating with microwave radiation the at least a portion of the matrix material; Element 4: heating involving radiant heating; Element 5: heating occurring in an oxygen-lean atmosphere; Element 6: heating occurring in an increased air pressure atmosphere; Element 7: the mold cavity being at least partially formed by a paper wrapper; Element 8: the organic porous mass having an EPD of about 0.1 mm of water per mm of length to about 25 mm of water per mm of length; Element 9: the organic porous mass having an EPD of about 0.1 mm of water per mm of length to about 20 mm of water per mm of length and the porous mass comprising the organic particles at about 1 mg/mm to about 20 mg/mm; Element 10: the natural material comprises at least one selected from the group consisting of cloves, tobacco, coffee beans, cocoa, cinnamon, vanilla, tea, green tea, black tea, bay leaves, citrus peels, orange, lemon, lime, grapefruit, cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and any combination thereof; Element 11: the organic particles having an average diameter of about 100 microns to about 1500 microns; Element 12: the binder particles comprising polyethylene; Element 13: the binder particles comprising UHMWPE; Element 14: the binder particles comprising VHMWPE; Element 15: the binder particles comprising HMWPE; and Element 16: the organic porous mass comprising at least one additive described herein.

By way of non-limiting examples, exemplary combinations independently applicable to J, K, L, and M include: Element 1 in combination with at least one of Elements 8-14; Element 2 in combination with at least one of Elements 8-14; Element 1 in combination with at least one of Elements 10-16; Element 3 in combination with at least one of Elements 10-16; Elements 1 and 3 optionally in combination with at least one of Elements 10-16; Elements 2 and 3 optionally in combination with at least one of Elements 10-16; Elements 1 and 4 optionally in combination with at least one of Elements 10-16; Elements 2 and 4 optionally in combination with at least one of Elements 10-16; any of the foregoing in combination with Element 5; any of the foregoing in combination with Element 6; any of the foregoing in combination with Element 7; any of the foregoing in combination with Element 8; any of the foregoing in combination with Element 9; and so on.

To facilitate a better understanding of the present invention, the following examples of preferred or representative embodiments are given. In no way should the following examples be read to limit, or to define, the scope of the invention.

EXAMPLES

Example 1

UHMWPE binder particles (about 125 micron average diameter) and clove organic particles (about 1.0 mm to about 2.0 mm average diameter) were mixed, placed in a mold having a diameter and cross-sectional shape consistent with a cellulose acetate cigarette filter, and heated to about 135° C. for 30 minutes, thereby yielding a clove porous mass. The clove porous mass was cut into segments of 5 mm, 10 mm, and 15 mm in length. The clove porous mass segments were combined with cellulose acetate cigarette filter segments to yield a plurality of segmented filter 21 mm in length. The segmented filters and a control cellulose acetate cigarette filter were attached to a commercial tobacco column.

The EPD of the various cigarettes (Table 1) was measured using Coresta Recommended Method (CRM) 41 with 5 cigarettes per measurement, and the delivery concentration of various smoke stream components (Table 2) were measured using the ISO smoke method ISO 3308.

TABLE 1

| Clove Segment Length (mm) | Mean EPD of Cigarettes (mm $H_2O$ per 21 mm length) | Standard Deviation |
|---|---|---|
| 0 | 119.0 | 3.8 |
| 5 | 116.4 | 7.8 |
| 10 | 116.1 | 11.3 |
| 15 | 127.8 | 17.6 |

TABLE 2

| Clove Segment Length (mm) | Water Delivery (mg/cig) | Nicotine Delivery (mg/cig) | Tar Delivery (mg/cig) | Eugenol Delivery (mg/cig) | Nicotine:Tar Ratio |
|---|---|---|---|---|---|
| 0 | 3.45 | 1.32 | 17.56 | 0 | 0.075 |
| 5 | 2.89 | 1.41 | 18.00 | 0.31 | 0.078 |
| 10 | 2.88 | 1.50 | 18.70 | 0.73 | 0.080 |
| 15 | 2.31 | 1.60 | 20.61 | 1.44 | 0.078 |

This example illustrates that the flavor from the clove organic particles (i.e., the eugenol) can be delivered via an organic porous mass. Further, the concentration of flavorant delivered is related to the length of the organic porous mass.

Example 2

UHMWPE binder particles (about 150 micron average diameter), clove organic particles (about 500 micron average diameter), and carbon particle additives (30×70 mesh) were mixed, placed in a mold lined with a paper wrapper, and heated to a variety of temperatures (Table 3) for 30 minutes optionally in an oxygen-lean atmosphere by purging the mold with helium then sealing the mold, thereby yielding a plurality of clove porous masses.

During heating, the furfural, methyl furfural, and alpha-furfural, the headspace gas was analyzed via gas chromatography as a measure of the clove organic particle decomposition byproducts released during heating, which in turn may indicate flavor degradation in the organic porous mass.

TABLE 3

| Temp. (° C.) | Furfural (area counts normalized to control) | Methyl Furfural (area counts normalized to control) | alpha-Furfural (area counts normalized to control) |
|---|---|---|---|
| clove control | 1.0 | 1.0 | 1.0 |
| 150 | 7.8 | 31.7 | 1.3 |
| 175 | 20.3 | 90.0 | 1.3 |

TABLE 3-continued

| Temp. (° C.) | Furfural (area counts normalized to control) | Methyl Furfural (area counts normalized to control) | alpha-Furfural (area counts normalized to control) |
|---|---|---|---|
| 175 ($O_2$-lean) | 2.6 | 4.5 | 0.4 |
| 200 | 35.3 | 170.0 | 1.3 |
| 220 | 50.4 | 352.2 | 1.1 |

As temperature increases for the sintering (i.e., heating) of the organic porous masses, the concentration of organic particulate decomposition byproducts increase. However, in an oxygen-lean atmosphere, the concentration of organic particle decomposition byproducts are reduced by about an order of magnitude for the same temperature.

This example demonstrates that production in an oxygen-lean atmosphere may advantageously mitigate organic particle decomposition.

Example 3

Several organic porous masses were produced with UHMWPE binder particles (about 125 micron average diameter) in combination with various organic particles: clove, cinnamon, and pipe tobacco. The sintering was performed at two temperatures (135° C., 175° C., or 220° C.) in either an air environment or an oxygen-lean environment (vacuumed mold followed by $N_2$ purge). The organic porous masses were then tested by people for two smell tests. First, the olfactory evaluation was based on the ability to smell the organic particles with a rating system from 0 to 10, where 0 smelled like the control (an unsintered mixture of the binder and organic particle) and 10 smelled completely different. Second, the burnt evaluation was based on the ability to smell a burnt aroma with a rating system from 0 to 5, where 0 smelled no burnt aroma and 5 smelled like a burnt control (the organic particle sintered at 220° C.). The results of the smell tests are provided in Table 4.

TABLE 4

| | Clove | | Cinnamon | | Pipe Tobacco | |
|---|---|---|---|---|---|---|
| | Smell Test | | | | | |
| | 1 | 2 | 1 | 2 | 1 | 2 |
| 135° C. ($O_2$-lean) | 3.6 | 0.45 | 3 | 0.15 | 3.6 | 0.7 |
| 135° C. | 3.5 | 1 | 3.7 | 0.3 | 4.2 | 0.8 |
| 175° C. ($O_2$-lean) | 5.5 | 1.2 | 5.7 | 0.8 | 5.7 | 1.8 |
| 220° C. ($O_2$-lean) | 9.1 | 4 | 9.7 | 3.45 | 9 | 4 |

This example demonstrates that lower temperature sintering and $O_2$-lean environments provide preferable olfactory characteristics for the organic porous masses described herein.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

introducing a matrix material into a mold cavity, the matrix material comprising a plurality of binder particles and a plurality of organic particles and not comprising active particles; and heating the matrix material in the mold cavity in an oxygen-lean atmosphere so as to bind the matrix material at a plurality of contact points thereby forming an organic porous mass.

2. The method of claim 1, wherein the natural material comprises at least one selected from the group consisting of cloves, tobacco, coffee beans, cocoa, cinnamon, vanilla, tea, green tea, black tea, bay leaves, citrus peels, orange, lemon, lime, grapefruit, cumin, chili peppers, chili powder, red pepper, eucalyptus, peppermint, curry, anise, dill, fennel, allspice, basil, rosemary, pepper, caraway seeds, cilantro, garlic, mustard, nutmeg, thyme, turmeric, oregano, other spices, hops, other grains, sugar, and any combination thereof.

3. The method of claim 1, wherein heating occurs in an air pressure greater than atmospheric pressure.

4. The method of to claim 1, wherein introducing the matrix material into the mold cavity is continuous and includes pneumatic dense phase feeding at a rate of about 1 m/min to about 800 m/min.

5. The method of claim 1, wherein the matrix material further comprises a microwave enhancement additive and heating involves microwave irradiation.

6. A method comprising:

introducing a matrix material into a mold cavity, the matrix material consisting of a plurality of binder particles and a plurality of organic particles and not comprising active particles;

heating at least a portion of the matrix material in an oxygen-lean atmosphere so as to bind the matrix material at a plurality of contact points, thereby forming an organic porous mass length, wherein heating involves irradiating with microwave radiation the at least a portion of the matrix material; and cutting the organic porous mass length radially thereby yielding an organic porous mass.

7. The method of claim 6, wherein introducing includes pneumatic dense phase feeding at a rate of about 1 m/min to about 800 m/min.

8. The method of claim 6, wherein introducing includes pneumatic dense phase feeding at a rate of about 1 m/min to about 800 m/min and the mold cavity has a diameter of about 3 mm to about 10 mm.

9. The method of claim 6, wherein the mold cavity is at least partially formed by a paper wrapper.

10. The method of claim 6, wherein heating occurs in an air pressure greater than atmospheric pressure.

11. A method comprising:

grinding a natural material into a plurality of organic particles;

introducing a matrix material into a mold cavity, the matrix material comprising a plurality of binder particles and a plurality of organic particles and not comprising active particles;

heating at least a portion of the matrix material in an oxygen-lean atmosphere so as to bind the matrix material at a plurality of contact points thereby forming an organic porous mass length; and cutting the organic porous mass length radially thereby yielding an organic porous mass.

12. The method of claim 11 further comprising: drying at least some of the organic particles.

13. The method of claim 11 further comprising: sizing the organic particles.

14. The method of claim 11, wherein heating occurs in an air pressure greater than atmospheric pressure.

* * * * *